US009853390B2

(12) United States Patent
Diessel et al.

(10) Patent No.: US 9,853,390 B2
(45) Date of Patent: Dec. 26, 2017

(54) HOUSING FOR A PLUG-TYPE CONNECTOR

(71) Applicant: PHOENIX CONTACT GMBH & CO. KG, Blomberg (DE)

(72) Inventors: Thorsten Diessel, Hiddenhausen (DE); Dennis Sprenger, Horn-Bad Meinberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/122,930

(22) PCT Filed: Mar. 3, 2015

(86) PCT No.: PCT/EP2015/054398
§ 371 (c)(1),
(2) Date: Sep. 1, 2016

(87) PCT Pub. No.: WO2015/132249
PCT Pub. Date: Sep. 11, 2015

(65) Prior Publication Data

US 2017/0077640 A1 Mar. 16, 2017

(30) Foreign Application Priority Data

Mar. 5, 2014 (DE) ..... 10 2014 102 930

(51) Int. Cl.
*H01R 13/502* (2006.01)
*H01R 13/508* (2006.01)
(Continued)

(52) U.S. Cl.
CPC ..... *H01R 13/508* (2013.01); *H01R 13/5841* (2013.01); *H01R 13/6583* (2013.01)

(58) Field of Classification Search
CPC ..... H01R 13/508
(Continued)

(56) References Cited

U.S. PATENT DOCUMENTS 3,971,614 A * 7/1976 Paoli ..... H01R 13/621 285/85
4,030,798 A * 6/1977 Paoli ..... H01R 13/621 285/85
(Continued)

FOREIGN PATENT DOCUMENTS

DE 19718392 A1 11/1998
DE 19952643 C1 * 3/2001 ..... H02G 3/18
(Continued)

*Primary Examiner* — Tulsidas C Patel
*Assistant Examiner* — Peter G Leigh
(74) *Attorney, Agent, or Firm* — Leydig, Voit & Mayer, Ltd.

(57) ABSTRACT

A housing for a plug-type connector includes a first housing part and a second housing part configured to be connected to the first housing part. The second housing part has a fastening device for fastening an electric cable to the housing. The second housing part is to be attached to the first housing part in an attachment direction in order to connect to the first housing part, and, in a connected position, is mechanically connected to the first housing part so that the second housing part is held on the first housing part counter to the attachment direction. The housing includes a resiliently adjustable locking element arranged on one of the housing parts, the locking element assuming a locking position in the connected position of the housing parts, in which locking position the locking element is engaged with an engagement portion of the other of the housing parts.

25 Claims, 15 Drawing Sheets

(51) Int. Cl.
*H01R 13/58* (2006.01)
*H01R 13/6583* (2011.01)

(58) Field of Classification Search
USPC ..... 439/695
See application file for complete search history.

(56) References Cited

U.S. PATENT DOCUMENTS

| | | | | | |
|---|---|---|---|---|---|
| 4,863,396 | A | | 9/1989 | Johnson | |
| 5,743,763 | A | * | 4/1998 | Giovanni | H01R 13/506 439/598 |
| 6,152,753 | A | * | 11/2000 | Johnson | H01R 13/622 439/312 |
| 7,102,078 | B2 | * | 9/2006 | Weber | G01D 11/245 174/50 |
| 2005/0074996 | A1 | | 4/2005 | Wong | |
| 2005/0287864 | A1 | | 12/2005 | Weber et al. | |

FOREIGN PATENT DOCUMENTS

| | | | | | |
|---|---|---|---|---|---|
| DE | 19718392 | C2 | * | 5/2002 | H02G 3/083 |
| DE | 10119910 | C1 | * | 8/2002 | G01D 11/24 |
| DE | 20308570 | U1 | | 10/2004 | |
| DE | 20201 21 029 | | * | 11/2013 | G01D 11/245 |
| DE | 202012102916 | U1 | | 11/2013 | |
| EP | 1437804 | A2 | | 7/2004 | |
| EP | 1610603 | A1 | | 12/2005 | |
| EP | 2253940 | A2 | | 11/2010 | |
| JP | 2009187955 | A | | 8/2009 | |
| WO | WO 9501664 | A1 | | 1/1995 | |

* cited by examiner

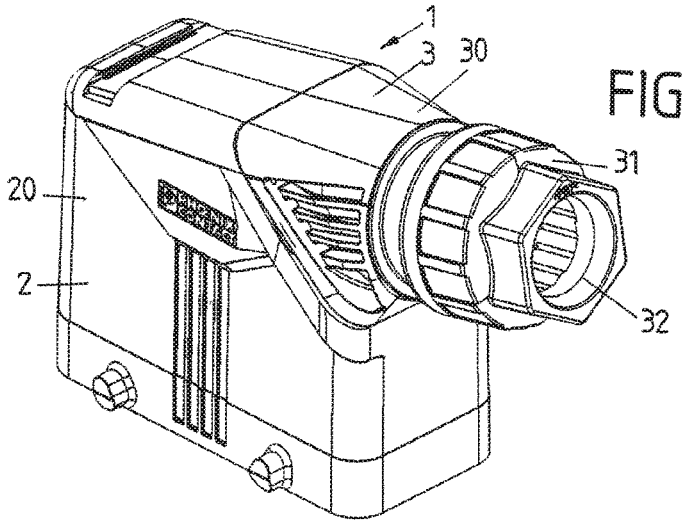
FIG 7A
FIG 7B
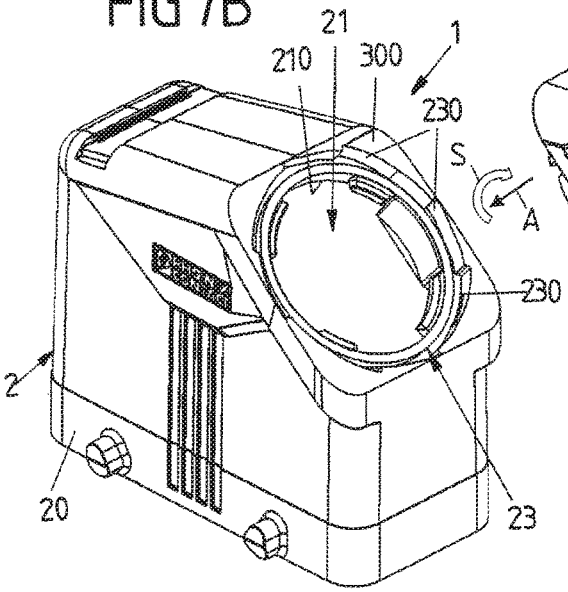
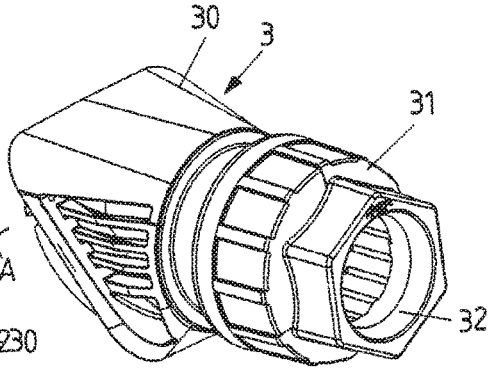
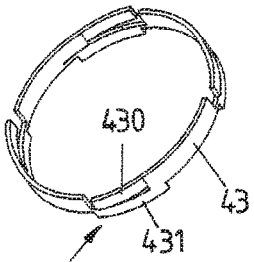
FIG 7D
FIG 7C
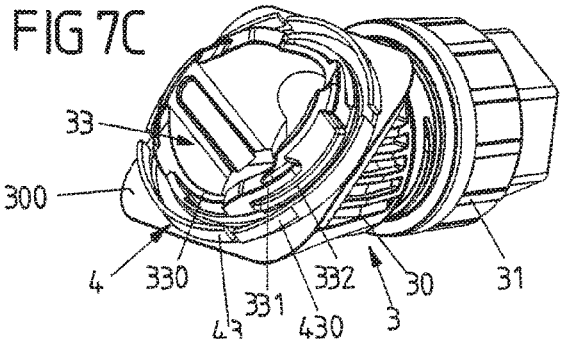

HOUSING FOR A PLUG-TYPE CONNECTOR

CROSS-REFERENCE TO PRIOR APPLICATIONS

This application is a U.S. National Phase application under 35 U.S.C. §371 of International Application No. PCT/EP2015/054398, filed on Mar. 3, 2015, and claims benefit to German Patent Application No. DE 10 2014 102 930.5, filed on Mar. 5, 2014. The International Application was published in German on Sep. 11, 2015 as WO 2015/132249 A1 under PCT Article 21(2).

FIELD

The invention relates to a housing for a plug-type connector.

BACKGROUND

A housing of this type may comprise a first housing part and a second housing part which is to be connected to the first housing part, which second housing part has a fastening device for fastening an electric cable to the housing. The second housing part can be attached to the first housing part in an attachment direction for connecting to the first housing part and, in a connected position, is mechanically connected to the first housing part in such a way that the second housing part is held on the first housing part counter to the attachment direction.

With such housings, different first housing parts which are configured dependent on the type and use of the plug-type connector can be connected to uniform second housing parts. With such a housing, the attachment of an electric cable to the housing is brought about via the second housing part, the second housing part having as a fastening device for fastening the cable for example a screw nut, by means of which clamping holding of the cable on the second housing part can be produced. Owing to the fact that a uniform second housing part can be used together with different variants of first housing parts, different housings for plug-type connectors can be produced in a simple, variable manner.

Such housings are used in particular for what are known as heavy-duty plug-type connectors. In the first housing part in such case is arranged a plug part which has a plug-in portion in the manner of a plug or a socket and which can be brought into plugged engagement with an associated other plug-type-connector part. Thus electrical contacting can be produced by means of the plug-type connector. Heavy-duty plug-type connectors in such case are characterized in that they can also withstand great stresses and to this end are configured to be correspondingly stable and resistant.

In conventional plug-type connectors of this kind, the housing is made for example from plastics material. This makes possible simple, secure fastening of the second housing part to the first housing part, for example by screwing the second housing part on to the first housing part, where if the housing is made from plastics material the housing parts can be braced with each other such that in the connected state they are held against each other securely and firmly, in particular also in a rotation-resistant manner.

Compared with housings which are produced from metal, for example aluminum, plastics-material housings however generally have lower thermal and mechanical resistance. Depending on the use of such housings, it may thus be desirable to manufacture the housing from metal, in particular aluminum. In such case, however, it must be ensured that when connecting the housing parts together the housing parts are held so firmly against each other that they cannot readily, at any rate not unintentionally, be detached from each other.

SUMMARY

A housing for a plug-type connector includes a first housing part and a second housing part configured to be connected to the first housing part. The second housing part has a fastening device for fastening an electric cable to the housing. The second housing part is to be attached to the first housing part in an attachment direction in order to connect to the first housing part, and, in a connected position, is mechanically connected to the first housing part so that the second housing part is held on the first housing part counter to the attachment direction. The housing includes a resiliently adjustable locking element arranged on one of the housing parts, the locking element assuming a locking position in the connected position of the housing parts, in which locking position the locking element is engaged with an engagement portion of the other of the housing parts so that the second housing part is locked relative to the first housing part counter to a direction of rotation that is directed about the attachment direction.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 7A is a view of a further embodiment of a housing;

FIG. 7B is a view of the housing of FIG. 7A, before the connection of the second housing part to the first housing part;

FIG. 7C is a separate view of the second housing part;

FIG. 7D is a separate view of a locking element in the form of a ring which is to be attached to the second housing part;

DETAILED DESCRIPTION

Figure 1A:
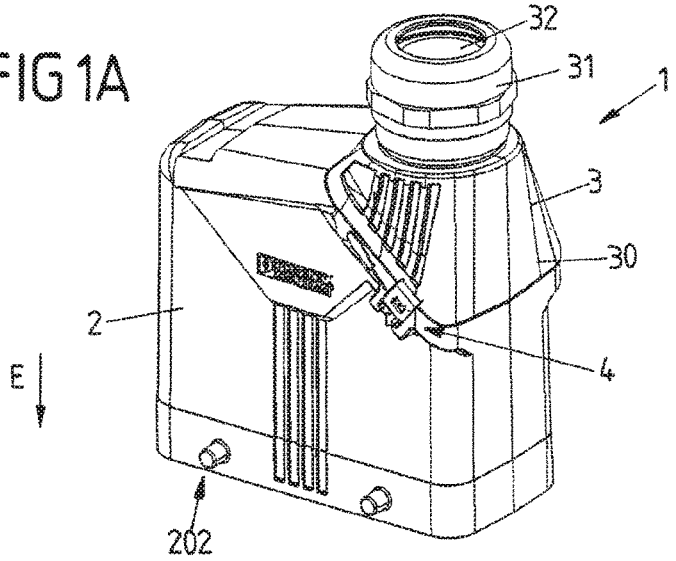
FIG. 1A is a view of a housing for a plug-type connector having a first housing part and a second housing part, with the second housing part in a first position relative to the first housing part.

In an embodiment, a resiliently adjustable locking element is provided which is arranged on one of the housing parts and assumes a locking position in the connected position of the housing parts, in which locking position the locking element is engaged with an engagement portion of the other of the housing parts in such a way that the second housing part is locked relative to the first housing part counter to a direction of rotation which is directed about the attachment direction.

The present invention departs from the concept of providing, via the resiliently adjustable locking element additionally provided, securing against rotation which prevents the housing parts in the connected position from being able to be turned relative to each other about the attachment direction along which the housing parts can be attached to each other for connection purposes. The housing parts in the connected position are thus held in position relative to each other via the locking element which provides securing against rotation.

If the housing parts are to be screwed together for connection purposes, by attaching the housing parts to each other in the attachment direction and then turning them relative to each other about the attachment direction, the locking element ensures that the connection of the housing parts together cannot readily be detached. It is ensured by means of the locking element that the housing parts which are screwed to each other are held in their rotary position relative to each other so that the screw connection between the housing parts cannot readily be detached.

The housing parts of the housing may be manufactured in particular from metal, for example aluminum.

Thus a stable, load-bearing, durable housing is made available, the housing parts of which can be formed to be particularly resistant. By providing the locking element, it is ensured that once the housing parts have been connected together turning of the housing parts relative to each other is not (any longer) possible and thus, for example when using a connection which is to be produced by screwing, for example a bayonet lock, the connection cannot readily be detached.

The locking element is advantageously formed to be resilient at least in portions and thus provides a resilient element. The locking element may be arranged for example on the first housing part and upon connection of the housing parts snaps into engagement with the engagement portion on the other, second, housing part, so that the housing parts are secured against turning relative to each other. To detach the housing parts from each other, the locking element can then be moved resiliently out of its locking position, so that the engagement with the engagement portion is cancelled out and the housing parts can be moved relative to each other, in particular can be turned relative to each other, in order optionally to detach a screw connection between the housing parts.

The locking element is arranged on one of the housing parts, while the engagement portion is arranged on the other of the housing parts. If the locking element is arranged for example on the first housing part, the engagement portion is located on the second housing part. If conversely the locking element is arranged on the second housing part, the engagement portion is located on the first housing part. The engagement portion may for example be formed by an indentation into which the locking element engages in the connected position of the housing parts, so that in the connected position there is a positive engagement for securing against turning between the locking element and the engagement portion.

Preferably the locking element projects with a resiliently movable portion along the attachment direction from an attachment face of one of the housing parts, to which face the other of the housing parts is to be attached in order to connect the housing parts. If the locking element is arranged for example on the first housing part, the locking element projects from an attachment face of the first housing part counter to the attachment direction in the direction of the second housing part, the second housing part in the connected position lying against the attachment face of the first housing part. If conversely the locking element is arranged on the second housing part, the locking element projects in the attachment direction from an attachment face of the second housing part in the direction of the first housing part. On the other housing part in each case, in such case the engagement portion is provided for example in the form of an indentation, so that in the connected position of the housing parts the locking element projecting along the attachment direction is engaged in a positive lock with the engagement portion.

The resiliently movable portion with which the locking element projects from the attachment face is preferably resiliently movable along the attachment direction. As a result, for example by pressing the resiliently movable portion into the attachment face, the positive lock between the locking element on the one housing part and the engagement portion on the other housing part can be cancelled out, so that the housing parts can be detached from each other.

The locking element may be configured in an entirely different manner. The locking element may for example be resilient in itself and thus be configured as a spring element; or the locking element may have an element which is rigid in itself and is spring-loaded by means of a spring element, for example in the manner of a pin which can be resiliently adjusted.

In a first specific variant, the locking element may be formed as a spring element and be received with a fastening portion in a receiving device of the associated one housing part, and may project from the attachment face with a spring portion. The spring portion may for example be bent over relative to the fastening portion, so that the fastening portion extends in the plane of the attachment face, but the spring portion on the other hand is bent out of the plane of the attachment face. The spring portion may in particular be formed to be resilient along the attachment direction, so that the spring portion firstly upon connection of the housing parts together can come into engagement resiliently with the engagement portion and secondly can be adjusted upon detaching the housing parts from each other to cancel out the engagement with the engagement portion.

In a second variant, the locking element is configured for example as a plate element and attached to a wall which forms the attachment face. In the wall there is formed for example an opening for passing through electric cable cores or the like from the second housing part to the first housing part, the locking element preferably surrounding the opening and projecting from the attachment face with at least one spring tongue. The spring tongue may for example be cut free from the plate element, so that the spring tongue can be moved resiliently relative to a body of the flap element. If the locking element is arranged on a side of the wall remote from the attachment face, the spring tongue in such case extends through a cutout in the wall, in order to project from the attachment face in the direction of the other housing part on the side of the wall facing the other housing part.

In a third variant, the locking element has a pin which is resiliently movable along the attachment direction. The pin may for example be arranged in a pin housing and be resiliently pre-tensioned relative to the pin housing via a suitable spring element, so that the pin is movable along the attachment direction in the pin housing. In a normal position, the pin protrudes from the attachment face of the associated housing part, and in the connected position of the housing parts is engaged with the associated engagement portion of the other housing part, so that the housing parts are secured against turning relative to each other. To detach the connection of the housing parts, the pin can be pressed into the pin housing, so that the positive lock between the pin and the engagement portion is cancelled out and the housing parts can thus be turned relative to each other.

In a fourth variant, the locking element comprises a spring pin which is resiliently movable transversely to the attachment direction and along the attachment direction, which upon connection of the housing parts can be deflected out of a base position transversely to the attachment direction. The spring pin for example upon turning of the second housing part in the direction of rotation relative to the first housing part for connecting the housing parts together enters into the engagement portion through an opening in the engagement portion and thus comes into engagement with the engagement portion. Upon running into the engagement portion, in such case the spring pin is deflected in the plane of the attachment face and upon further turning of the housing parts relative to each other finally snaps into engagement with the engagement portion, so that in the connected position of the housing parts it lies in a locking manner against a wall portion of the engagement portion.

In the connected position, the engagement of the spring pin in the engagement portion in this case is such that the housing parts are secured against turning relative to each other. To detach the connection of the housing parts, the spring pin can be pressed into the attachment face along the attachment direction, so that in this manner the engagement of the spring pin with the engagement portion can be cancelled out.

In a further variant, the locking element is formed by a ring element which has at least one spring tongue which is resiliently movable radially to the attachment direction. The locking element in the form of the ring element may for example be attached to the attachment face of the associated housing part, and in the connected position of the housing parts comes to lie in an indentation in the other housing part. In such case, the at least one radially movable spring tongue for locking the second housing part with the first housing part engages radially to the attachment direction in an engagement portion in the other housing part, so that by means of this engagement securing against rotation is provided between the housing parts.

If the one or the plurality of spring tongues of the ring element extend(s) in the peripheral direction and is/are bent such that they project radially outwards from a ring body of the ring element, then the ring element can provide a type of freewheel which permits turning in the direction of rotation to produce for example a screw connection between the housing parts, but on the other hand blocks turning-back counter to the direction of rotation. Upon turning-back, the spring tongues enter into a positive lock with the engagement portions on the other housing part, and in this manner block any movement of the housing parts relative to each other.

In these variants, the locking element may for example be formed from spring steel. If the housing with its housing parts is manufactured from aluminum, in such case it should be ensured that no corrosion due to the locking element lying flat on the associated housing part occurs. For this, the locking element may for example be provided with a suitable corrosion coating, a paint or alternatively zinc-plating.

Alternatively, it is also conceivable and possible to produce the locking element from plastics material or from aluminum.

In principle, it is sufficient if one engagement portion is formed on the other housing part, with which portion the locking element in the connected position of the housing parts is in locking engagement. In this manner, the housing parts can be connected together in exactly one position. It is however also conceivable and possible to provide on the other housing part a plurality of engagement portions spaced apart from each other along the direction of rotation, which permit connection of the second housing part to the first housing part in different rotary positions. In this manner, the second housing part can be attached to the first housing part variably in different positions, so that for example it becomes possible to guide the cable away in different directions from the housing.

To connect the housing parts together, as stated, the second housing part is preferably attached in the attachment direction to the first housing part and is then to be turned for example relative to the first housing part, in order to produce a connection between the housing parts in a screwing manner. In such case, closure portions may be provided on the first housing part and the second housing part, which portions in a suitable manner form threaded turns or undercuts for producing a bayonet lock or the like. If the housing parts are attached to each other and screwed against each other, in this manner secure holding of the housing parts against each other counter to the attachment direction is provided, with additionally securing against rotation of the housing parts relative to each other being provided via the locking element and the engagement thereof in the engagement portion.

The closure portions for producing the screw connection, for example in the manner of a bayonet lock, are for example arranged rigidly on the first housing part and the second housing part. For example, one of the housing parts may have a projecting collar which is to be inserted into an opening in the other housing part to connect the housing parts. On the collar and on a surrounding edge surrounding the opening, in such case closure portions are formed which can be brought into engagement with each other in a positive lock for connecting the housing parts by the housing parts being screwed together.

It is however also conceivable and possible to provide on one of the housing parts a closure element which is resilient at least in portions, which in the connected position is engaged in a positive lock with a closure portion of the other of the housing parts, so that the second housing part is held counter to the attachment direction on the first housing part. Such a resilient closure element may for example permit attachment of the housing parts to each other and production of a connection of the housing parts together, without the housing parts additionally having to be screwed together to produce the connection. By means of the resilient closure element, a connection in the manner of latching can be produced by simply attaching the housing parts to each other in the attachment direction.

The aspect of the provision of a resilient closure element on one of the housing parts represents an independent inventive concept which in principle can also be used for securing against rotation independently of the provision of a locking element. A housing for a plug-in connection in this case generally has a first housing part and a second housing part which is to be connected to the first housing part and has a fastening device for fastening an electric cable to the housing, wherein the second housing part is to be attached to the first housing part in an attachment direction for connecting to the first housing part, and, in a connected position, is mechanically connected to the first housing part in such a way that the second housing part is held on the first housing part counter to the attachment direction. In this case provision is made for one of the housing parts to have a closure element which is resilient at least in portions, which in the connected position is engaged in a positive lock with at least one closure portion of the other of the housing parts, so that the second housing part is held on the first housing part counter to the attachment direction.

The advantages and advantageous configurations described previously in principle also apply to this housing, so that reference is to be made to what has been discussed previously. In particular, the details and variants described can also be used in combination with this housing.

Preferably the at least one closure portion with which the closure element is to be brought into engagement is formed to be rigid. The at least one closure portion may in such case be formed for example by an edge portion surrounding an opening, to which portion the closure element is to be attached in a positive lock. On this edge portion there may be provided for example a latching lip, with which the resilient closure element can be brought into engagement in a positive lock by attaching the housing parts to each other.

The closure element is formed for example by a ring extended about the attachment direction, which ring, at least in portions, is formed to be elastically resilient.

In a first variant, the ring may have at least one radially projecting portion. The ring in such case is for example arranged on a collar of the associated housing part in such a way that the ring projects radially from the collar with the at least one radially projecting portion and can be brought into engagement with the at least one closure portion of the other housing part.

It is conceivable that the radially projecting portion can move away radially elastically resiliently, so that by attaching the housing parts to each other the radially projecting portion of the closure element can snap into engagement with the associated closure portion of the other housing part.

It is however also conceivable for the radially projecting portion not to be elastically resilient in the radial direction. In this case, the radially projecting portion for attaching the housing parts to each other can be guided for example through a suitable cutout on the closure portion, in order by subsequent turning of the housing parts together to be brought into engagement with the closure portion.

In a specific, advantageous configuration, the ring—viewed in the peripheral direction—may have an undulating profile which is formed by adjoining different portions which are offset relative to each other axially to the attachment direction. The ring thus runs in an undulating manner along the peripheral direction between different heights. This permits axial play compensation in the connected position of the housing parts, in that the ring is resiliently braced in the connected position axially along the attachment direction. If the ring in a resiliently braced manner in the connected position of the housing parts produces a positive engagement with the closure portion of the other housing part, in this manner it is ensured that axial play (along the attachment direction) between the housing parts is compensated and the housing parts along the attachment direction are thus held against each other without play.

In another variant, the ring may have a ring body which bears at least one spring portion which is bent over relative to the ring body and projects radially from the ring body. The spring portion is radially resilient and can in this manner be brought into engagement with the closure portion by simply attaching the housing parts to each other in the attachment direction.

If the ring body has a plurality of spring portions spaced equally apart, in this manner advantageous connection together of the housing parts can be produced. By means of the spring portions, in such case in principle also securing against rotation of the housing parts relative to each other can be provided, in that one or more spring portions engage in a positive lock in associated cutouts on the other housing part.

In a further variant, the closure element may also be arranged on the associated housing part so as to be displaceable transversely to the attachment direction, and may be displaced on the associated housing part in order to produce the connection between the housing parts. In this case, the closure element may be formed for example by a spring element which has two arms extended transversely to the attachment direction, which arms in the connected position are engaged with the at least one closure portion and can be adjusted transversely to the attachment direction in order to detach the connection between the housing parts.

In the connected position, the arms of the spring element engage for example in an undercut in the closure portion and thus hold the housing parts against each other along the attachment direction. In order to detach the housing parts from each other, the spring element can be adjusted in order in this manner to bring the arms out of engagement with the undercut, so that the housing parts can be removed from each other.

FIG. 1A, 1B to 5A, 5B show a first embodiment of a housing 1 which has two housing parts 2, 3 which are to be attached to each other along an attachment direction A to form the housing 1 and are to be screwed together in a direction of rotation S to connect the housing parts 2, 3.

The housing 1 is a component of a plug-type-connector part which can be brought into plugged engagement with another plug-type-connector part in order to produce an electrical connection. On the first housing part 2, an opening 202 is formed on a side remote from the second housing part 3, into which opening can be inserted a plug part which forms a plug-in portion in the form of a plug or a socket. The plug-type-connector part can thus be connected to another plug-type-connector part via the side of the housing 1 which bears the opening 202, by bringing the housing 1 into plugged engagement with the other plug-type-connector part in a direction of insertion E.

The first housing part 2 has a substantially cuboid housing body 20 enclosing a cavity, on which body—at an angle of for example 45° to the direction of insertion E—is formed an attachment face 200, to which the second housing part 3 is to be attached. Analogously, the second housing part 3 also has an attachment face 300 which in the connected position of the housing parts 2, 3 lies flat against the attachment face 200 of the first housing part 2.

The second housing part 3 bears a fastening device 31 in the form of a screw nut, which serves for connecting and fastening an electric cable to the second housing part 3. By means of the fastening device 31, an electric cable can be fixed to the second housing part 3, the electric cable extending through an opening 32 in the screw nut and being able to be connected in a clamping manner to the second housing part 3 by screwing the screw nut onto a housing body 30 of the second housing part 3.

Figure 1B:
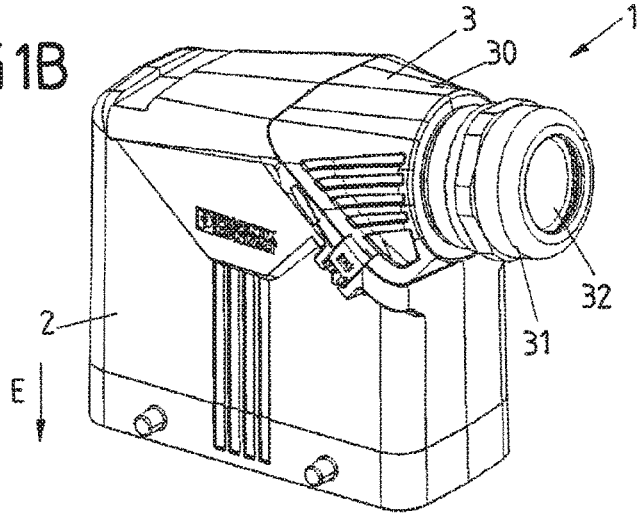
FIG. 1B is a view of the housing, with the second housing part in a second position, which is turned relative to the first position, relative to the first housing part.
Figure 2:
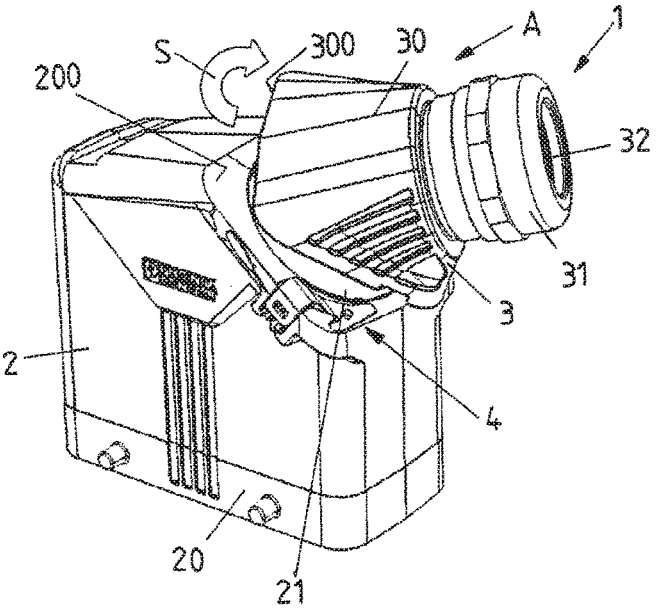
FIG. 2 is a view of the housing on attaching the second housing part to the first housing part.
Figure 3A:
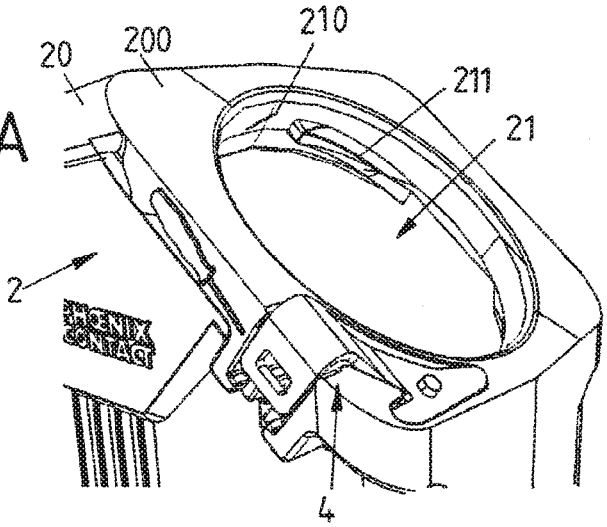
FIG. 3A is an enlarged view of the first housing part in the region of an attachment face to which the second housing part is to be attached for connection purposes, with a locking element attached to the attachment face.
Figure 3B:
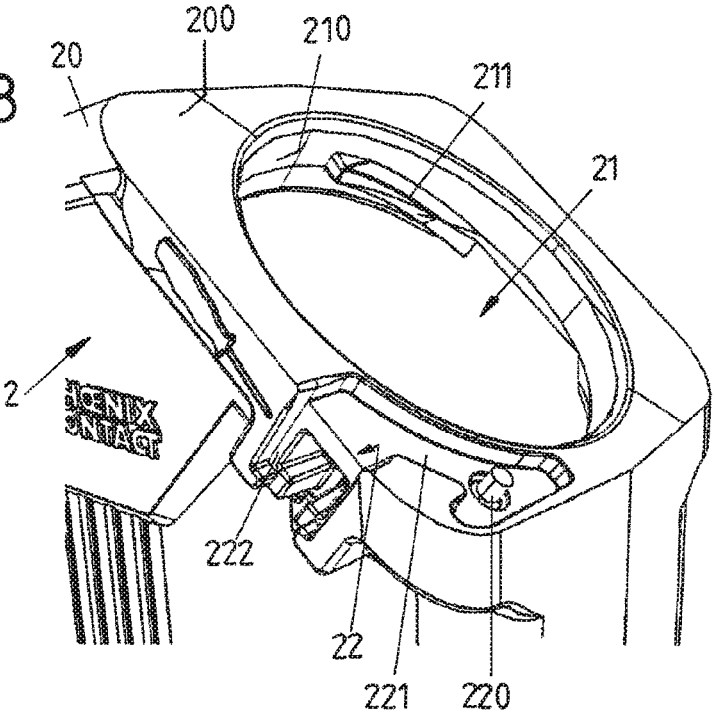
FIG. 3B is the view of FIG. 3A, but without the locking element.
Figure 4A:
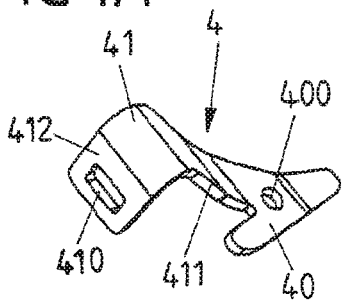
FIG. 4A, 4B are separate views of the locking element.
Figure 4B:
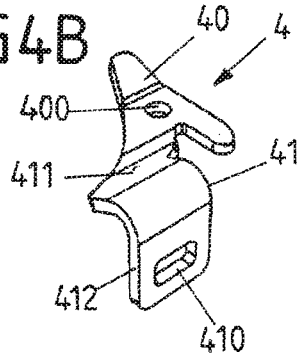
Figure 5A:
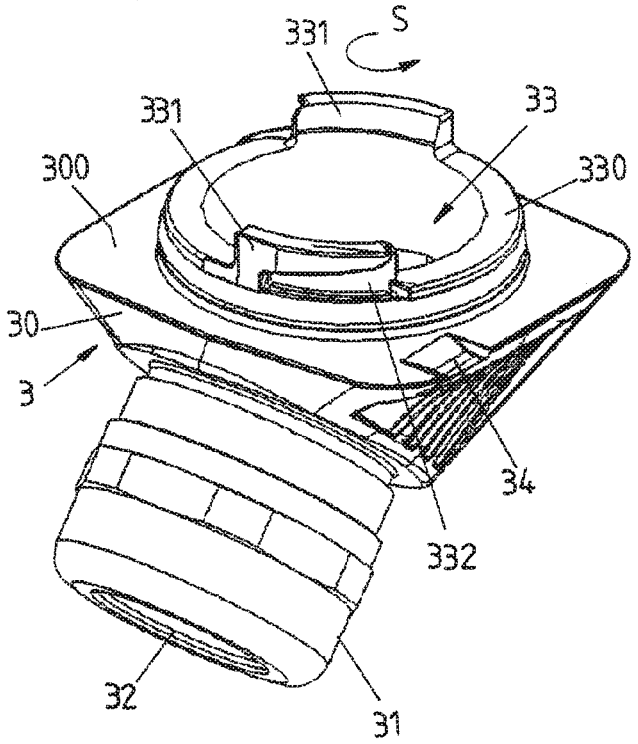
FIG. 5A, 5B are views of the second housing part.
Figure 5B:
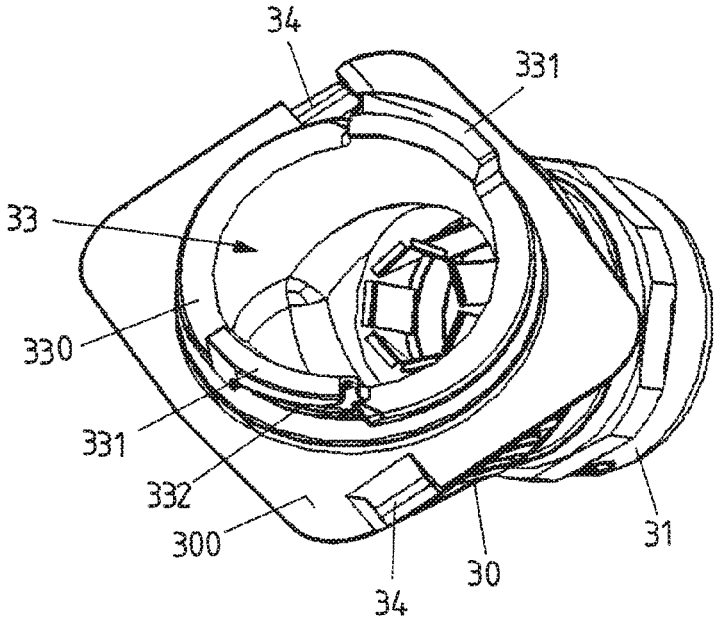
Figure 6A:
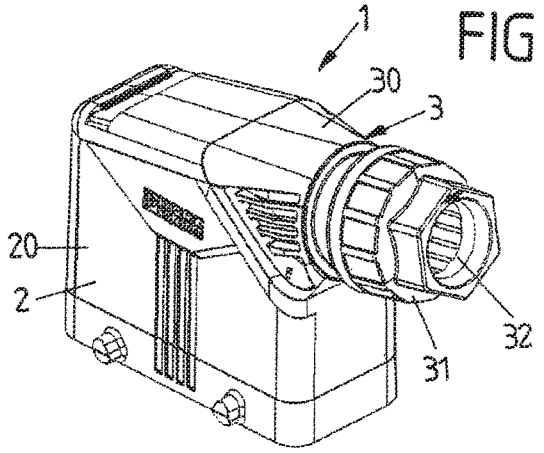
FIG. 6A is a view of a further embodiment of a housing, in the connected position of the housing parts.
Figure 6B:
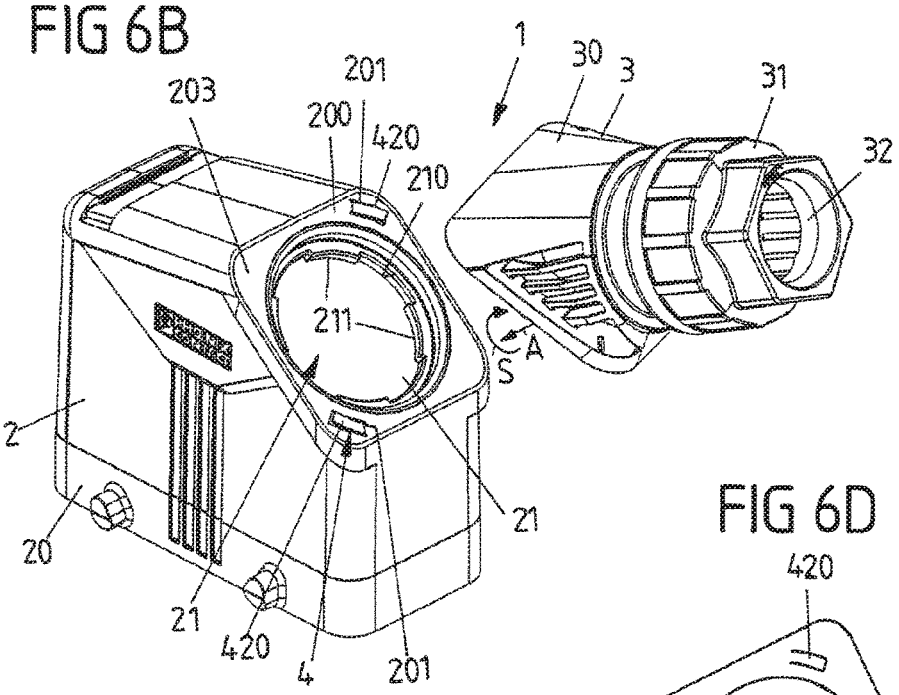
FIG. 6B is a view of the housing of FIG. 6A, before the attachment of the second housing part to the first housing part.
Figure 6D:
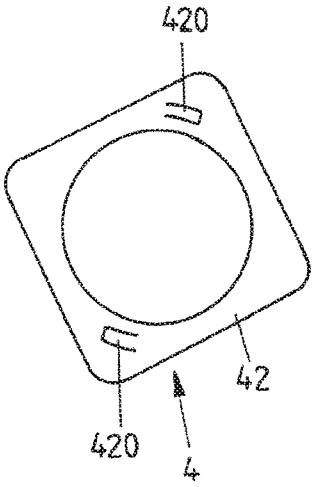
FIG. 6D is a separate view of a locking element which is to be attached to the first housing part.
Figure 6C:
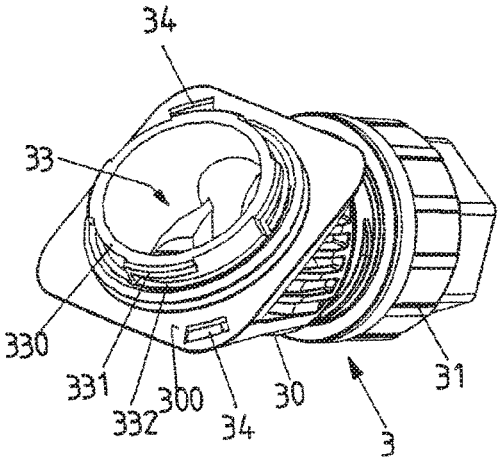
FIG. 6C is a separate view of the second housing part.
Figure 6E:
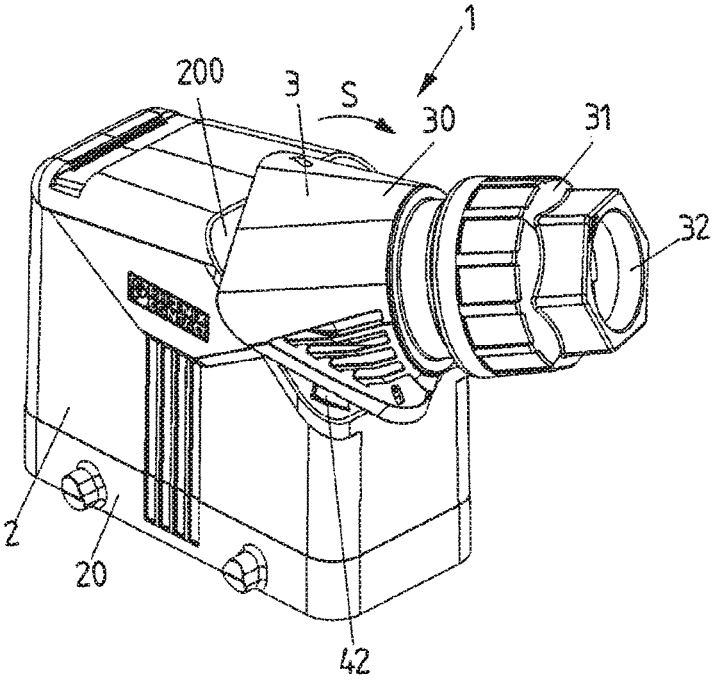
FIG. 6E is a view of the housing upon connection of the housing parts.
Figure 6F:
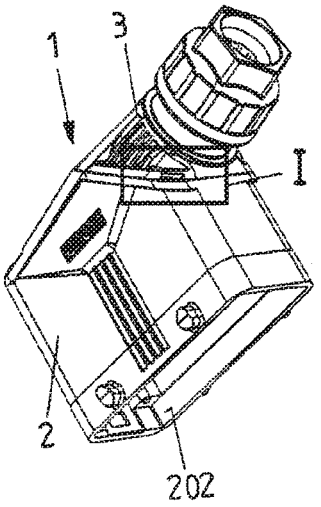
FIG. 6F is another view of the housing in the connected position.
Figure 6G:
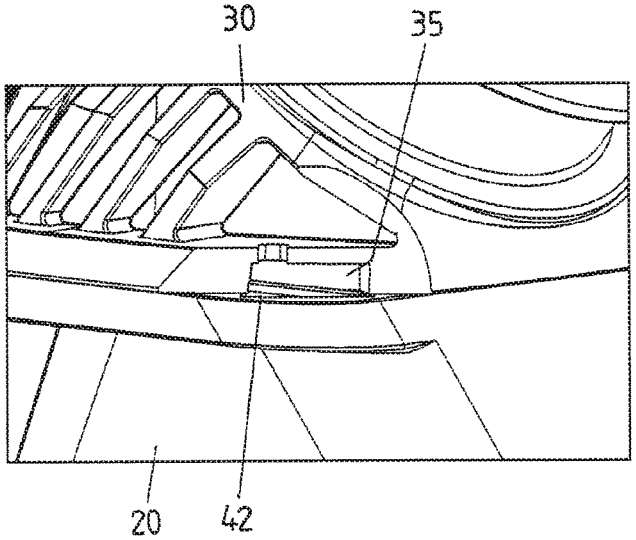
FIG. 6G is an enlarged view of the housing in the detail I of FIG. 6F.

The second housing part 3 can in principle be connected to the first housing part 2 in different positions, as is illustrated in FIGS. 1A and 1B.

For example, the second housing part 3 in a first position, illustrated in FIG. 1A, may be attached to the first housing part 2 in such a way that the fastening device 31 for connecting the electric cable projects along the direction of insertion E upwards from the first housing part 2. In this manner, the electric cable can be guided away from the housing 1 along the direction of insertion E.

In another position, illustrated in FIG. 1B, the second housing part 3 is turned by 180° about the attachment direction A relative to the position of FIG. 1A, so that the fastening device 31 points away from the first housing part 2 transversely to the direction of insertion E.

An electric cable can thus be guided away from the housing 1 in a different way by different application of the second housing part 3 to the first housing part 2.

Generally, forming the housing 1 from two housing parts 2, 3 makes it possible to use a uniform, universal second housing part 3 in conjunction with different first housing parts 1 which are configured dependent on the specific requirements. The housing parts 2, 3 in such case are preferably manufactured from metal, for example aluminum, and have—for example compared with plastics-material housings—good thermal and mechanical resistance, which can make it possible to use the housing 1 even in extreme conditions.

To connect the housing parts 2, 3 together, the second housing part 3 is attached to the first housing part 2 in the attachment direction A and then screwed to the first housing part 2 in the direction of rotation S. As can be seen from FIG. 5A, 5B, the second housing part 3 has on its attachment face 300 a projecting collar 330, on which are formed closure portions 331 with cutouts 332 formed therein in the manner of undercuts. With this collar 330, the second closure part 3 can be inserted into an opening 21 in the attachment face 200 of the first closure part 20 (see FIG. 3A, 3B), so that the closure portions 331 are brought into engagement with closure portions 211 projecting radially inwards on a peripheral surrounding edge 210 of the opening 21, and in this manner the housing parts 2, 3 are screwed together.

The collar 330 surrounds an opening 33 in the attachment face 300 of the second housing part 3, which opening in the connected position of the housing parts 2, 3 is flush with the opening 21 in the attachment face 200 of the first housing part 2. Cable cores of the electric cable can be guided through the openings 33, 21 from the second housing part 3 to the cavity enclosed by the first housing part 2.

To the attachment face 200 of the first housing part 2 there is attached a locking element 4 which comes to lie with a fastening portion 40 in an indentation portion 221 on the attachment face 200 and is held on the attachment face 200 by means of a fastening element 220 in the form of a peg. The locking element 4 has a spring portion 41 which is bent relative to the fastening portion 40 in such a way that it projects from the attachment face 200 along the attachment direction A. The spring portion 41 in such case extends away from the attachment face 200 with a first portion 411 of the fastening portion 40 and is bent over at an end remote from the fastening portion 40 with a portion 412 in such a way that the portion 412 comes to lie in an indentation portion 222 on a wall of the housing 2 which is extended transversely to the attachment face 200.

On the portion 412 there is provided an opening 410 for providing a tool engagement device, so that the spring portion 41 can be pressed into the attachment face 200 using a tool.

The locking element 4 serves to provide securing against rotation. On connecting the housing parts 2, 3 together, the housing parts 2, 3 are screwed together in the direction of rotation S, as a result of which the locking element 4 on the attachment face 200 comes into contact with the attachment face 300 of the second housing part 3 and runs on to the attachment face 300. If the second housing part 3 has reached the connected position, in which the closure portions 211, 331 are engaged together in a positive lock, the locking element 4 then snaps with its spring portion 41 into an indentation 34 in the attachment face 300 of the second housing part 3, so that a positive lock in the plane of rotation of the housing parts 2, 3—i.e. in the plane of the attachment faces 200, 300—is produced and thus the housing parts 2, 3 cannot (any longer) be turned relative to each other. It is thus not readily possible to detach the screw connection between the housing parts 2, 3, at any rate not without adjusting the locking element 4 in such a way that the engagement of the locking element 4 in the cutout 34 is cancelled out.

If the connection of the housing parts 2, 3 is to be detached, an intervention can be made in the opening 410 of the locking element 4 by means of a tool, for example by means of a screwdriver, in order in this manner to press the spring portion 41 into the attachment face 200 of the first housing part 2 so that the locking element 4 comes out of engagement with the cutout 34. Then turning-back counter to the direction of rotation S of the second housing part 3 relative to the first housing part 2 is possible, so that the screw connection between the housing parts 2, 3 can be cancelled out.

On the attachment face 300 of the second housing part 3—lying opposite each other diametrically to the opening 33—are arranged two cutouts 34 which, as illustrated in FIG. 1A, 1B, permit connection of the second housing part 3 while bringing about securing against rotation with the first housing part 2 in two different positions.

In principle, in this context it is also conceivable to provide more, for example four, cutouts 34, so that the second housing part 3 can also additionally be arranged on the first housing part 2 in a manner secured against rotation in further positions (provided that corresponding closure portions 211, 331 which permit such a connection are provided on the housing parts 2, 3).

FIG. 6A to 6G show a further embodiment of a housing 1 which differs from the embodiment previously described in the configuration of the locking element 4, but is otherwise functionally identical, so reference should also be made to the preceding statements.

In the embodiment of FIG. 6A to 6G, the locking element 4 is configured as a plate element 42 and on the inside is attached to a wall 203 of the first housing part 2 which forms the attachment face 200. The plate element 42 has two spring tongues 420 which are cut free in portions, which are bent over along the attachment direction A in such a way that they extend through openings 201 in the attachment face 200 of the first housing part 2 and project from the attachment face 200 along the attachment direction A towards the second housing part 3.

The spring tongues 420, in the assembled locking element 4, lie opposite each other diametrically to the opening 21 in the attachment face 200. On the attachment face 300 of the second housing part 3 there are formed two cutouts 34 which lie opposite each other diametrically to the opening 33 in the attachment face 300 and are engaged with the spring tongues 420 in the second housing part 3 which is connected to the first housing part 2.

To connect the housing parts 2, 3, the second housing part 3 is again attached to the first housing part 2 in the attachment direction A and—as described previously for the embodiment according to FIG. 1A, 1B to 5A, 5B—is connected to the first housing part 2 by screwing. In the connected position, the spring tongues 420 of the locking element 4 are engaged with the cutouts 34, so that the housing parts 2, 3 are secured against turning relative to each other and the screw connection between the housing parts 2, 3 cannot readily be cancelled out, at any rate not without releasing the securing against rotation.

To detach the connection of the housing parts 2, 3, an intervention can be made in a tool engagement device 35 on the second housing part 3 with a tool (see FIG. 6G), in order in this manner to act on the spring tongue 420 and to press it into the attachment face 200.

In an embodiment illustrated in FIG. 7A to 7D, a locking element 4 is formed by a ring 43 which is attached via plug-in portions 431 to the attachment face 300 of the second housing part 3 and is connected firmly to the second housing part 3 thereby. The ring 43 has spring portions in the manner of spring tongues 430, which portions are bent radially outwards and extend in the peripheral direction, and in the assembled position it projects from the attachment face 300 of the second housing part 3, as is illustrated in FIG. 7C.

To attach the housing parts 2, 3 to each other, the second housing part 3 is attached into the first housing part 2 in the direction of insertion A, so that the collar 330 projecting in the attachment direction A which is arranged on the attachment face 300 of the second housing part 3 is inserted into the opening 21 in the attachment face 200 of the first housing part 2 and the closure portions 331 of the collar 330 are brought into engagement with the closure portions 211 on the surrounding edge 210 of the opening 21.

As a result, the ring 43 too is inserted into a locking receptacle 23 on the attachment face 200 of the first housing part 2, with the spring tongues 430 sliding along the inner peripheral face of the locking receptacle 23 due to the housing parts 2, 3 being screwed to each other, and in the connected position (FIG. 7A) coming into engagement with radially formed engagement portions 230 on the inner peripheral face of the locking receptacle 23.

Owing to the shaping of the spring tongues 430 which extend along the periphery, the engagement with the engagement portions 230 is such that turning of the housing parts 2, 3 relative to each other counter to the direction of rotation S is blocked. Upon turning of the second housing part 3 counter to the direction of rotation S, the spring tongues 430 run with their ends onto the sawtooth-shaped engagement portions 230, so that any rotary movement counter to the direction of rotation S is blocked. Turning in the direction of rotation S is in principle however not blocked, so that—in the manner of a freewheel—it is readily possible to turn the housing parts 2, 3 relative to each other in the direction of rotation S to close the connection.

Otherwise, the housing 1 is functionally identical to the embodiments described previously, so reference should also be made to what has been stated previously.

In an embodiment illustrated in FIG. 8A to 8E, a locking element 4 is arranged on the attachment face 200 of the first housing part 2, which element projects from the attachment face 200 with a pin 440 and in the connected position of the housing parts 2, 3 engages in an engagement portion 34 in the form of a hole in the attachment face 300 of the second housing part 3, so that the housing parts 2, 3 are blocked against turning relative to each other.

Figure 8A:
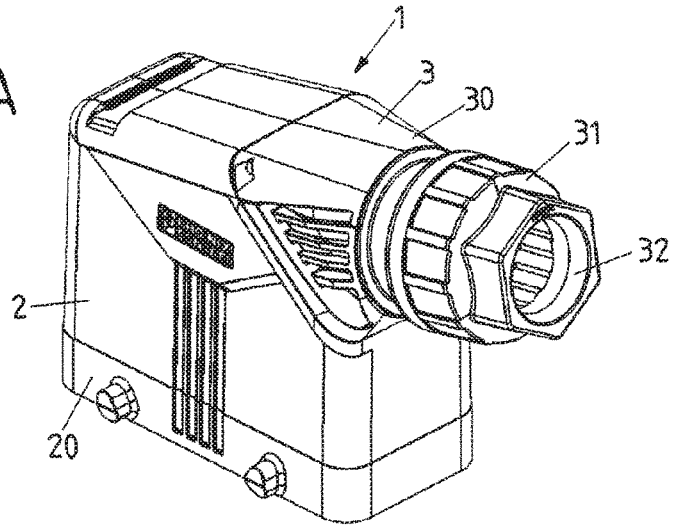
FIG. 8A is a view of a further embodiment of a housing.
Figure 8B:
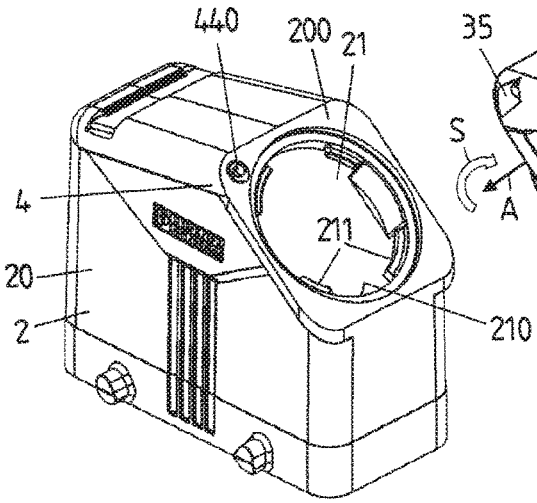
FIG. 8B is a view of the housing of FIG. 8A, before the connection of the second housing part to the first housing part.
Figure 8B:
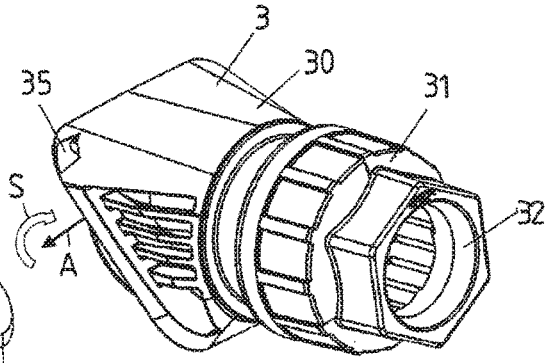
Figure 8C:
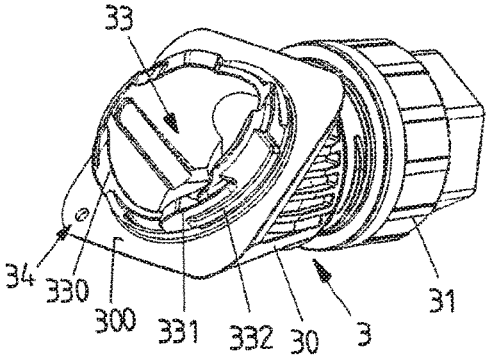
FIG. 8C is a separate view of the second housing part.
Figure 8D:
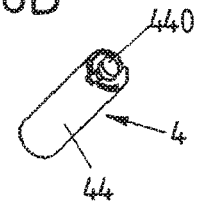
FIG. 8D is a separate view of a locking element, comprising a pin housing and a resiliently adjustable pin arranged therein.
Figure 8E:
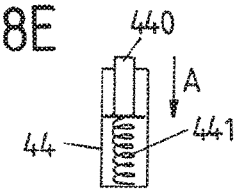
FIG. 8E is a schematic view of the locking element.

As can be seen in FIGS. 8D and 8E, the pin 440 is arranged adjustably along the attachment direction A in a pin housing 44 and in so doing is pre-tensioned relative to the pin housing 44 by means of a spring element 441 for example in the form of a compression spring. The pin housing 44 is inserted into the first housing part 2 in such a way that the pin 440, as illustrated in FIG. 8B, projects from the attachment face 200 counter to the attachment direction A.

To detach the connection between the housing parts 2, 3, the pin 440 can be acted on via a tool engagement device 35 by means of a tool (see FIG. 8B) and said pin can be pressed into the attachment face 200, so that the securing against rotation between the housing parts 2, 3 is cancelled out and the housing parts 2, 3 can be turned relative to each other counter to the direction of rotation S in order to detach the screw connection.

Otherwise, this embodiment too is functionally identical to the embodiments described previously, so reference is also to be made to the preceding statements.

A further embodiment is illustrated in FIG. 9A-9B to 12A-12F. In this embodiment, a spring pin 45 is provided as locking element 4 on the attachment face 200 of the first housing part 2, which pin is resiliently adjustable firstly along the attachment direction A and secondly in the plane of the attachment face 200, i.e. transversely to the attachment direction A. For this, the spring pin 45, as indicated schematically in FIG. 12A to 12F, is spring-loaded relative to a housing portion of the first housing part 2 via a spring element 450.

On connecting the housing parts 2, 3 together, the second housing part 3—as described previously—is attached in the attachment direction A to the first housing part 2 and is screwed in the direction of rotation S with the first housing part 2, as a result of which closure portions 211, 331 come into engagement in a screw connection. Upon turning the housing parts 2, 3 relative to each other, in such case the spring pin 45 also comes into engagement with an engagement portion 34 on the second housing part 3, so that in the connected position of the housing parts 2, 3 the housing parts 2, 3 are secured against turning relative to each other.

Figure 9A:
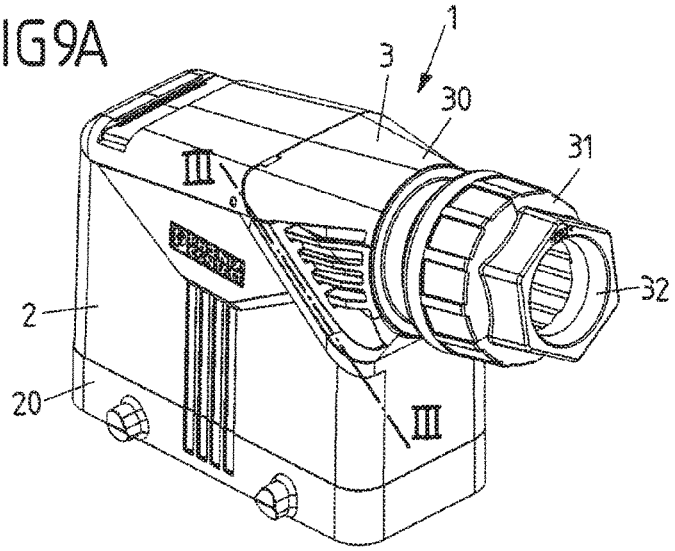
FIG. 9A is a view of a further embodiment of a housing.
Figure 9B:
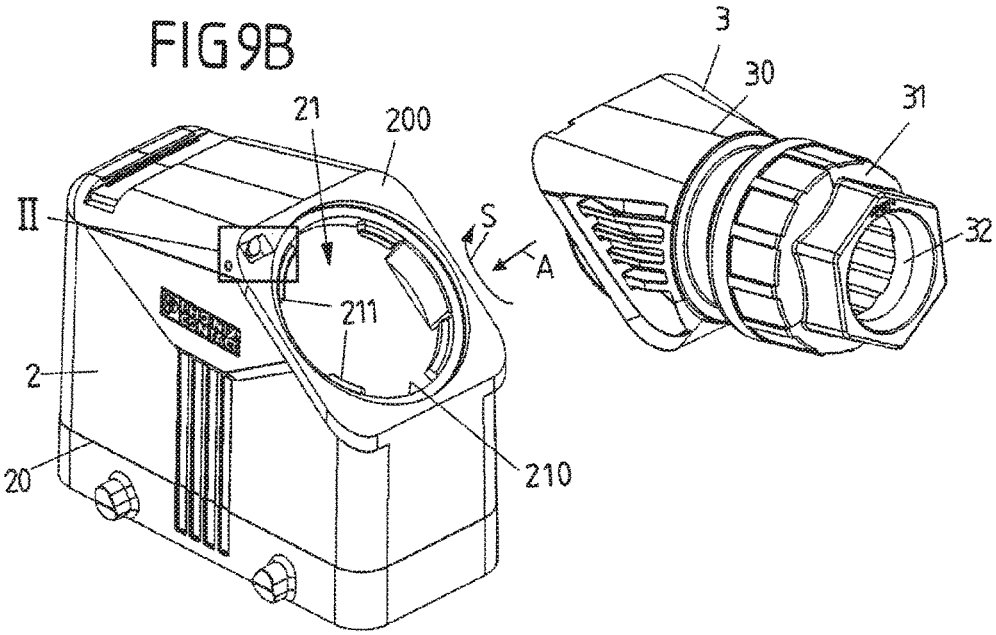
FIG. 9B is a view of the housing of FIG. 9A, before the connection of the second housing part to the first housing part.
Figure 9D:
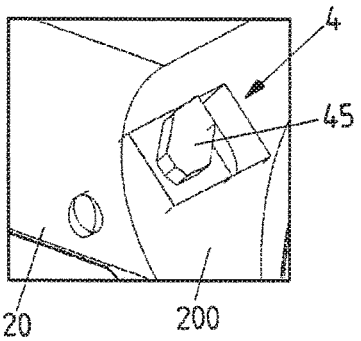
FIG. 9D is an enlarged view of a spring pin on an attachment face of the first housing part in the detail II of FIG. 9B.
Figure 9C:
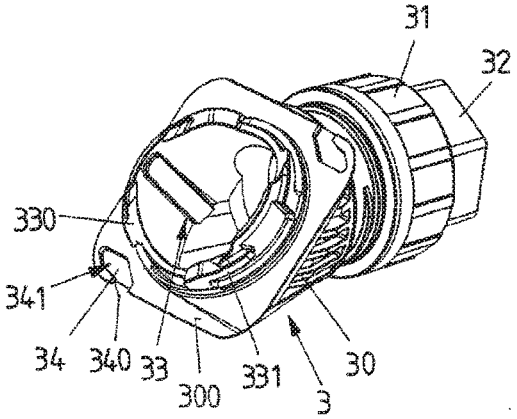
FIG. 9C is a separate view of the second housing part.
Figure 10A:
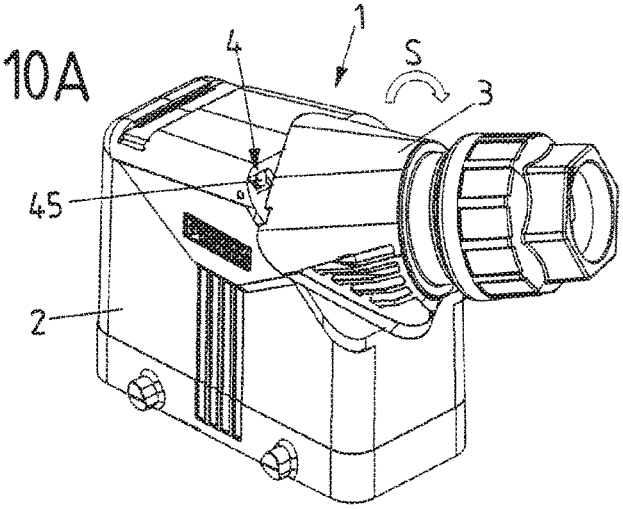
FIG. 10A-10C are views upon connecting the housing parts of the housing of FIG. 9A together.
Figure 10B:
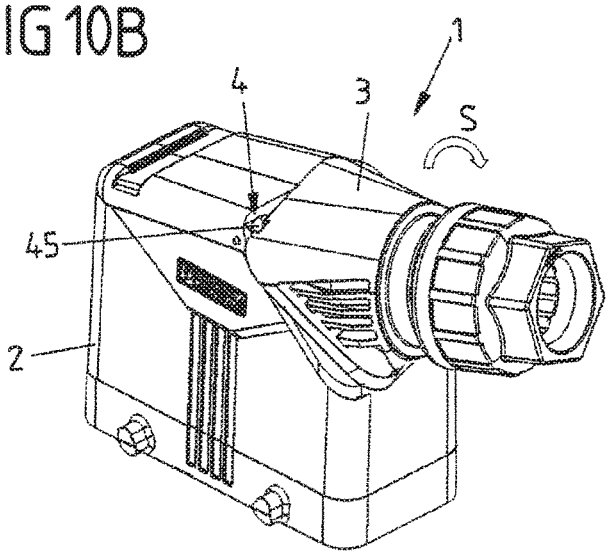
Figure 10C:
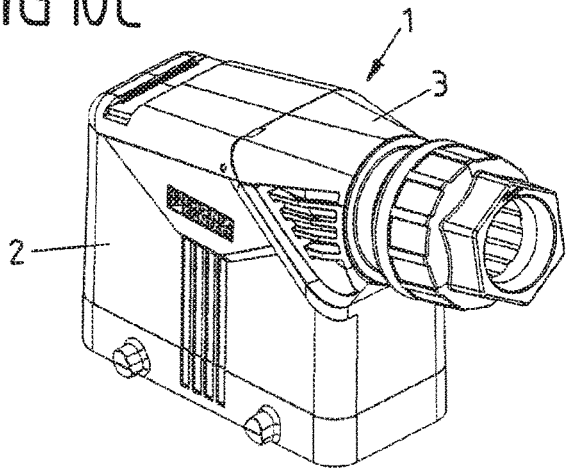
Figure 11:
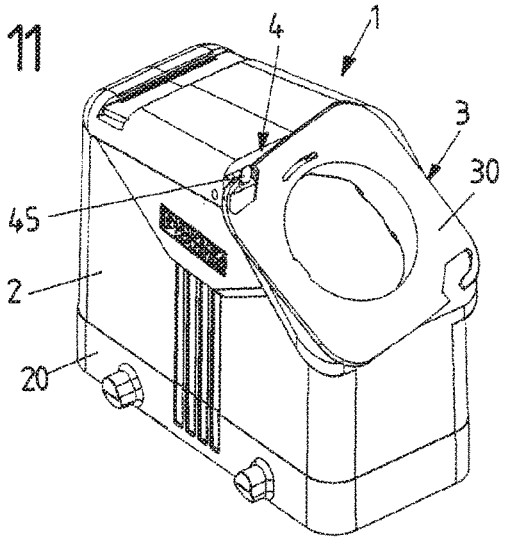
FIG. 11 is a view of the housing, with the second housing part in section along the line of FIG. 9A.
Figure 12A:
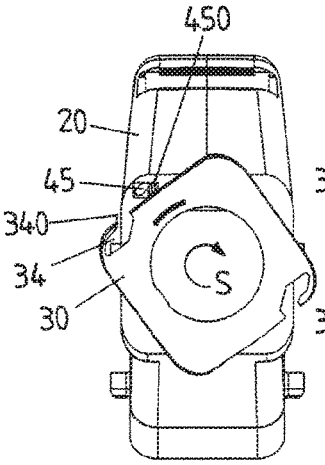
FIG. 12A-12F are different views of the housing upon connecting the housing parts together, with the second housing part in section as in FIG. 11.
Figure 12B:
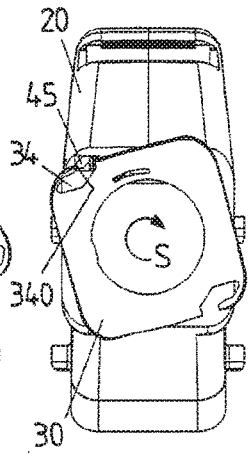
Figure 12C:
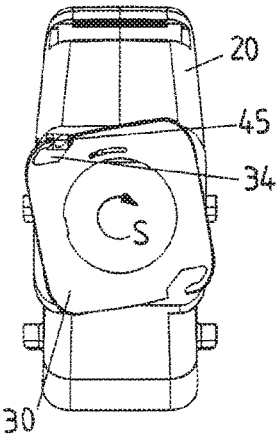
Figure 12D:
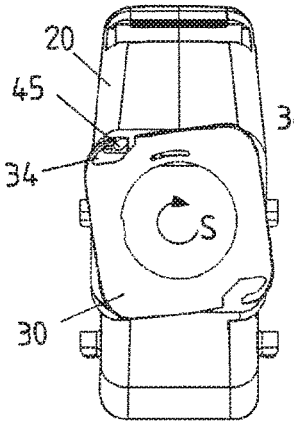
Figure 12E:
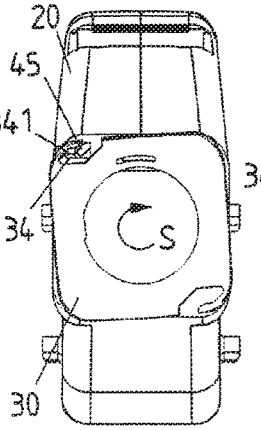
Figure 12F:
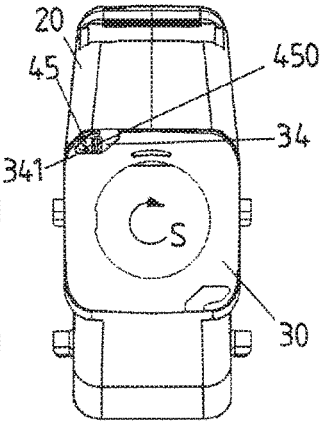
Figure 13A:
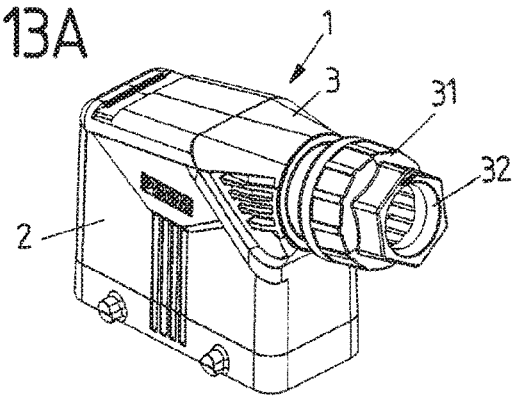
FIG. 13A is a view of a further embodiment of a housing.
Figure 13B:
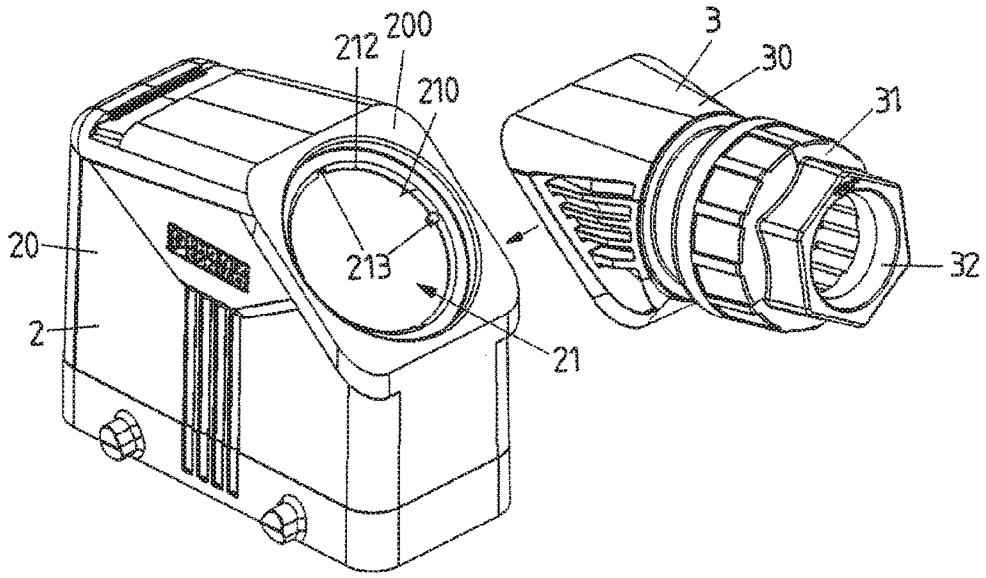
FIG. 13B is a view of the housing of FIG. 13A, before the connection of the second housing part to the first housing part.
Figure 13C:
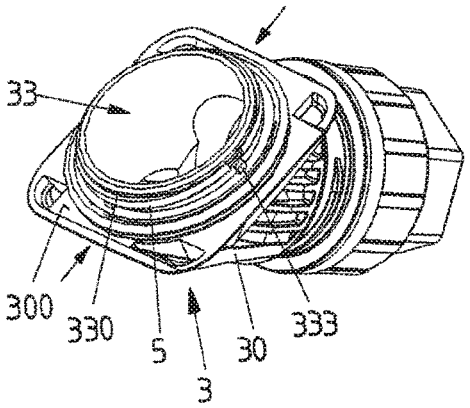
FIG. 13C is a separate view of the second housing part.
Figure 13D:
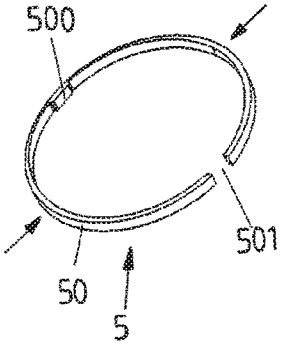
FIG. 13D is a separate view of an elastically resilient closure element which is to be attached to the second housing part.

As can be seen from the views of FIG. 12A to 12F (the second housing part 3 in such case is in section along the line in FIG. 9A), upon turning of the second housing part 3 relative to the first housing part 2 in the direction of rotation S, in order to connect the housing parts 2, 3 together, the spring pin 45 comes into engagement with the engagement portion 34, which is formed as an indentation, on the attachment face 300 of the second housing part 3. The spring pin 45 in such case first of all enters into the engagement portion 34 (FIG. 12B, 12C) through a lateral opening 340 and in so doing is adjusted resiliently in the direction of rotation S, so that the spring pin 45 moves away laterally. Upon further turning (FIG. 12D, 12E), the spring pin 45 is pushed into the engagement portion 34 and, if the second housing part 3 has reached its final position relative to the first housing part 2, snaps into engagement with the engagement portion 34 in such a way that the spring pin 45 comes to lie with a wall 341 of the engagement portion 34 which is remote from the opening 340. In this position, the spring pin 45 blocks turning of the housing parts 2, 3 relative to each other, so that the screw connection between the housing parts 2, 3 cannot readily be detached.

To detach the screw connection, a user can intervene with a tool through the opening 340 into the engagement portion 34 and press the spring pin 45 in the attachment direction A into the attachment face 200 of the first housing part 2, so that the engagement of the spring pin 45 with the engagement portion 34 is cancelled out and the housing parts 2, 3 can be separated from each other by detaching the screw connection.

In the embodiments described previously, securing against rotation to secure the rotary position between the housing parts 2, 3 is provided using a resiliently adjustable locking element 4. Below, embodiments will be described with reference to FIG. 13A-13D to 16A-16D in which using a resilient closure element a closure between the housing parts 2, 3 which acts counter to the attachment direction A is provided. Such a closure using a resilient closure element can also be combined in this case with securing against rotation in the manner of the embodiments described previously.

In an embodiment according to FIG. 13A to 13D, a closure element 5 in the form of a split washer 50 is arranged on a collar 330 on the attachment face 300 of the second housing part 3. The ring 50 surrounds the collar 330 and is axially fixed on the collar 330 along the attachment direction A, and is also secured against turning relative to the collar 330 via a protrusion 500 which points radially inwards. The ring 50 is opened at one point on the periphery and for this purpose has a cutout 501, so that the ring 50 can be radially compressed. Correspondingly, the ring 50 is held on the collar 330 in such a way that the ring 50 can be compressed in the radial direction at least by a certain distance.

To connect the housing parts 2, 3 together, the second housing part 3 is pushed in the attachment direction A onto the first housing part 2, in that the collar 330 is inserted into the opening 21 in the attachment face 200 of the first housing part 2. The collar 330 in such case is inserted with pegs 333 projecting radially outwards in cutouts 213 on a latching lip 212 formed on the inner surrounding edge 210 of the opening 21, the ring 50 running on to the latching lip 212, in so doing moving away radially inwards and after passing the latching lip 212 widening radially again, so that the ring 50 engages in a positive lock behind the latching lip 212 and thus a positive connection between the housing parts 2, 3 counter to the attachment direction A is produced.

Due to the engagement of the pegs 333 in the cutout 213, in such case securing against rotation between the housing parts 2, 3 is also provided, so that the housing parts 2, 3 are fixed in their rotary position relative to each other. Due to the fact that the ring 50 is arranged on the collar 330 axially offset relative to the pegs 333, the pegs 333 come to lie in the cutouts 213, while the ring 50 engages behind the latching lip 212, so that a positive connection between the housing parts 2, 3 which is secured against rotation is produced.

On the collar 330 there are provided four pegs 333 which are spaced apart from each other by 90° about the attachment direction A, which are to be brought into engagement with four cutouts 213 on the inner surrounding edge 210 of the opening 21. The equidistant arrangement of the pegs 333 and the cutouts 213 permits connection of the housing parts 2, 3 together in four different rotary positions, which in each case are turned relative to each other by 90° about the attachment direction A.

If this closure using the closure element 5 is to be combined with one of the preceding embodiments, the securing against rotation via the pegs 333 and the cutouts 212 can be dispensed with and can be replaced by securing against rotation in accordance with one of the embodiments previously described.

In an embodiment illustrated in FIG. 14A to 14F, a closure element 5 in the form of a plate-shaped spring element 51 is arranged on the second housing part 3, which element is adjustable along an adjustment direction V transversely to the attachment direction A on the second housing part 3. The spring element 51 has arms 510, 511 which are connected together via a transverse portion 512 and are elastically resilient in such a way that they can at least slightly move away transversely to the attachment direction A.

To connect the housing parts 2, 3 together, the second housing part 3 is attached with an opening 33 formed in the attachment face 300 to a collar 24 on the attachment face 200 of the first housing part 2. The spring element 51 in such case is located in the position illustrated in FIG. 14E, which is only partially inserted into the housing body 30, so that ends of the arms 510, 511 protrude approximately centrally (viewed along the adjustment direction V) into the opening 33 on the lateral edge of the opening 33. In this position, the arms 510, 511 can be guided with their ends through cutouts 242 on an upper edge 240 of the collar 24 of the first housing part 2 in the attachment direction A.

If the second housing part 3 is attached to the first housing part 2 in the attachment direction A, the closure element 5 is inserted into the second housing part 3 in such a way that a protrusion 513 on the transverse portion 512 of the spring element 51 comes into engagement with a cutout 334 on the attachment face 300 of the second housing part 3 and the arms 510, 511 receive the collar 24 between them. The arms 510, 511 are then in the position illustrated in FIG. 14C and come to lie in a groove-shaped indentation 241 which runs around the collar 24, so that a positive lock with the collar 24 is produced via the arms 510, 511 and the second housing part 3 is thus held on the first housing part 2.

Figure 14A:
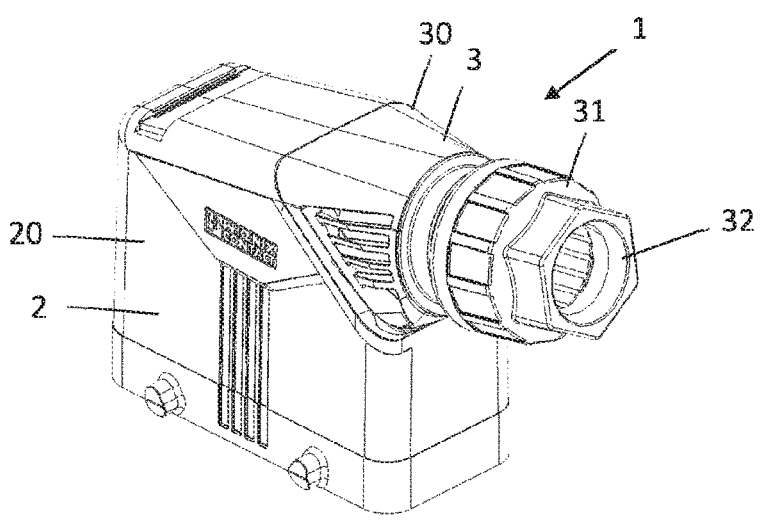
FIG. 14A is a view of a further embodiment of a housing.
Figure 14B:
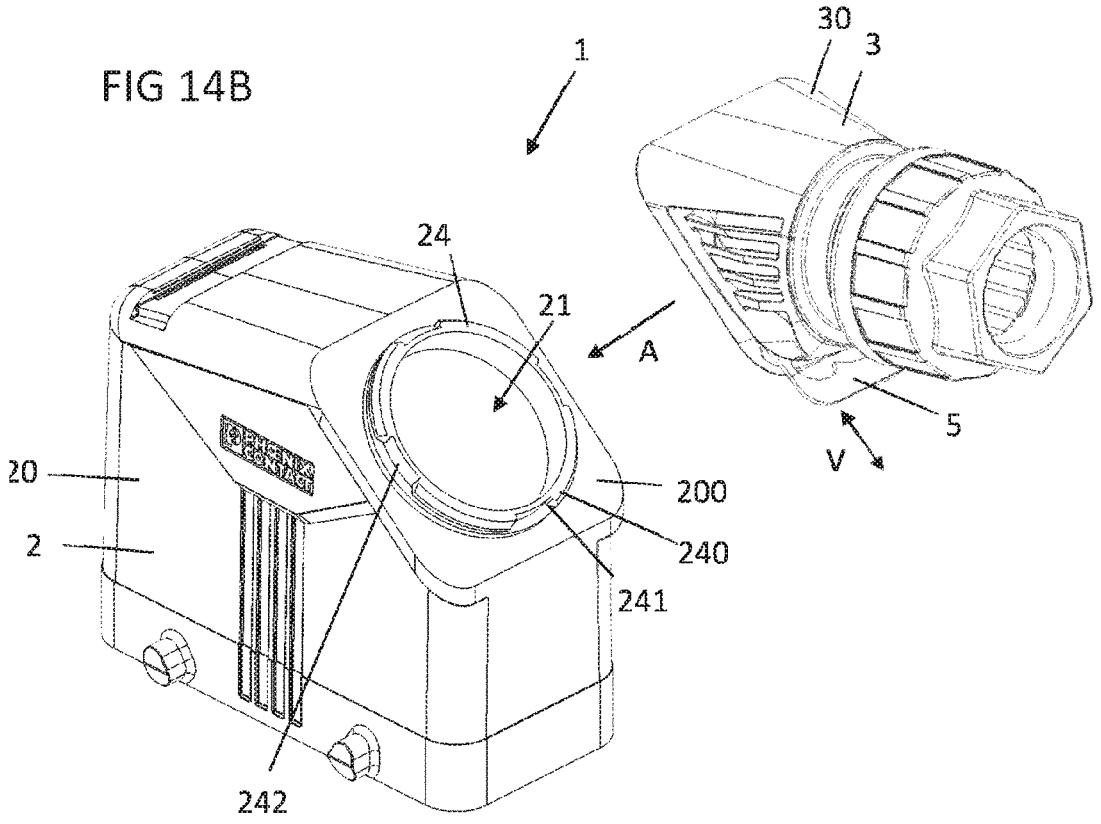
FIG. 14B is a view of the housing of FIG. 14A, before the connection of the second housing part to the first housing part.
Figure 14C:
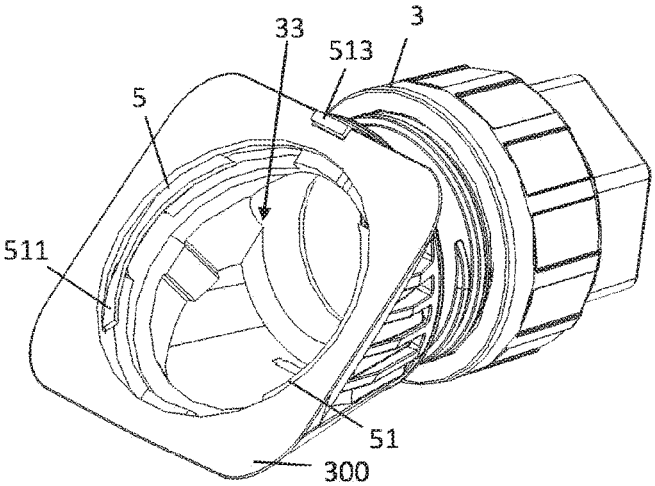
FIG. 14C is a separate view of the second housing part, in the connected position.
Figure 14D:
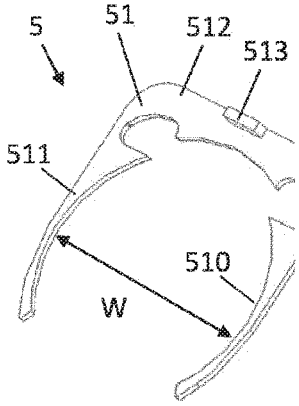
FIG. 14D is a separate view of an elastically resilient closure element which is to be arranged in a transversely adjustable manner on the second housing part, corresponding to the connected position of the second housing part.
Figure 14E:
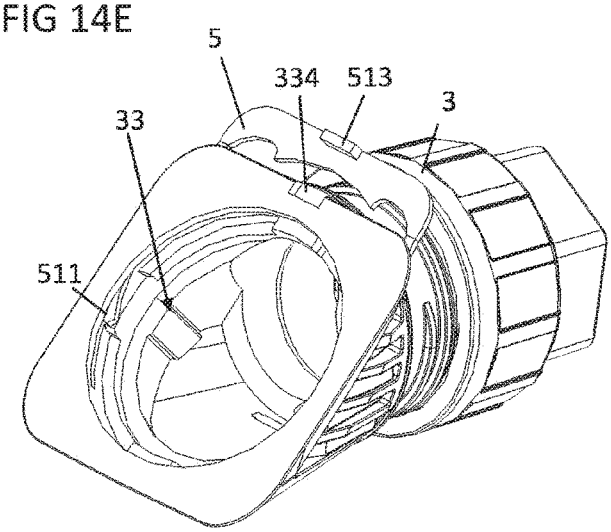
FIG. 14E is a separate view of the second housing part, in the non-connected position.

To detach the connection, the closure element 5 can again be brought into the position of FIG. 14E, so that the arms 510, 511 can be guided with their ends through the cutouts 242 on the edge 240 of the collar 24 and the second housing part 3 can be removed from the first housing part 2.

The spring element 51 is formed for example from spring steel and is resilient at least in the region of its arms 510, 511. In the connected position, the arms 510, 511 in such case engage around the collar 24 and come to lie in the indentation 241 on the collar 24, the arms having a spacing W relative to each other and being very largely relieved of tension (see FIG. 14D).

Figure 14F:
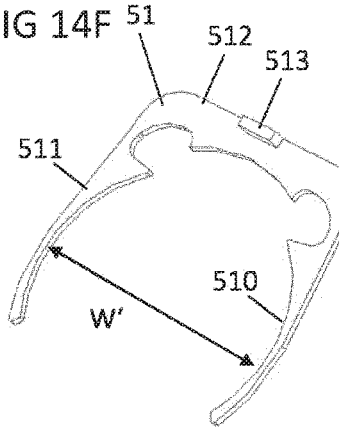
FIG. 14F is a separate view of an elastically resilient closure element which is to be arranged in a transversely adjustable manner on the second housing part, corresponding to the non-connected position of the second housing part.

If the spring element 51 has been transferred into the position illustrated in FIG. 14E in order to remove the second housing part, the spacing W' of the arms 510, 511 relative to each other is widened, as is illustrated in FIG. 14F. For this purpose, for example a suitable guide is provided on the housing body 30 of the second housing part 3, by means of which guide the spring element 51 is guided displaceably on the second housing part 3 along the adjustment direction V.

In an embodiment illustrated in FIG. 15A to 15E, a closure element 5 in the form of a split washer 52 is arranged on a collar 330 on the attachment face 300 of the second housing part 3. The split washer 52 has different portions 520, 521 which adjoin each other in the peripheral direction, which firstly project outwards at radially different distances and secondly are located axially at different heights (see FIGS. 15D and 15E). The split washer 52 as a result—observed in the peripheral direction—has an undulating profile with portions 520, 521 which are located both axially and radially differently.

Figure 15A:
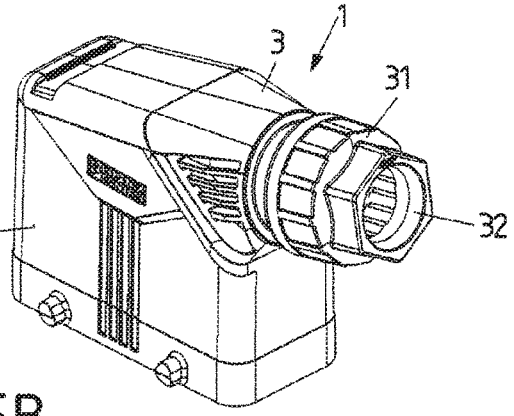
FIG. 15A is a view of a further embodiment of a housing.
Figure 15B:
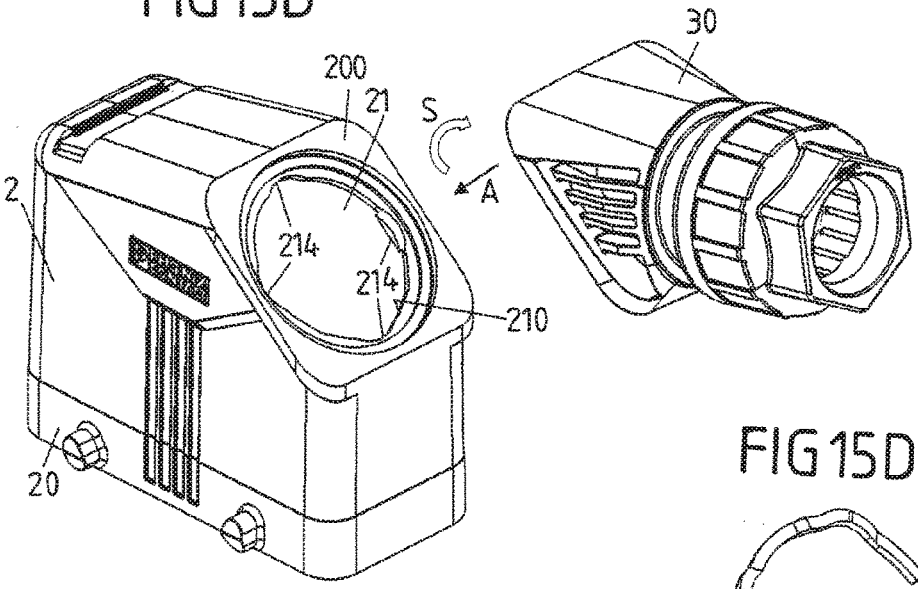
FIG. 15B is a view of the housing of FIG. 15A, before the attachment of the second housing part to the first housing part.
Figure 15D:
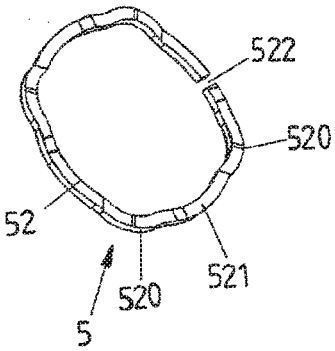
FIG. 15D is a separate view of an elastically resilient closure element which is to be attached to the second housing part.
Figure 15C:
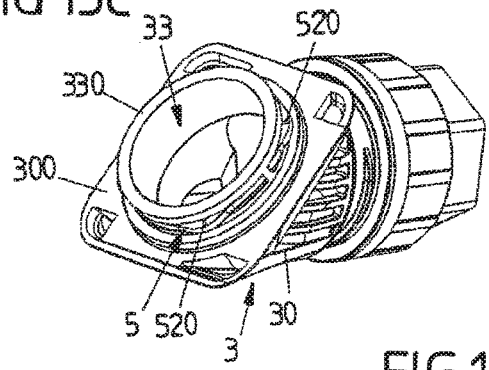
FIG. 15C is a separate view of the second housing part.
Figure 15E:
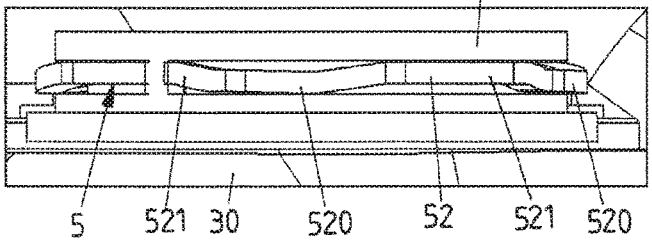
FIG. 15E is a side view of the closure element on the second housing part.
Figure 16A:
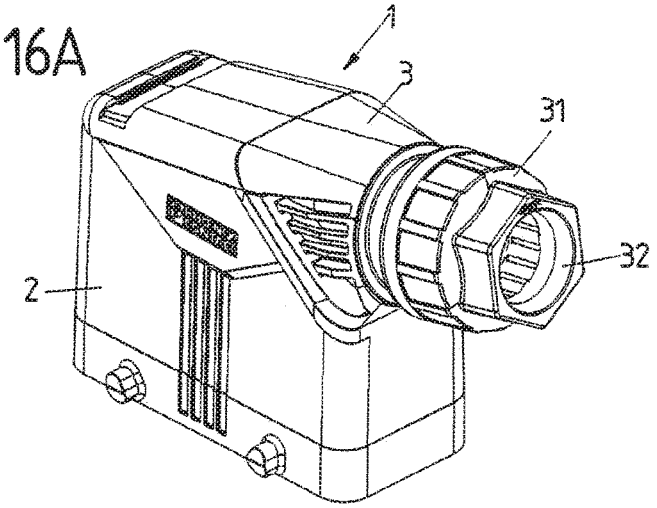
FIG. 16A is a view of a further embodiment of a housing.
Figure 16B:
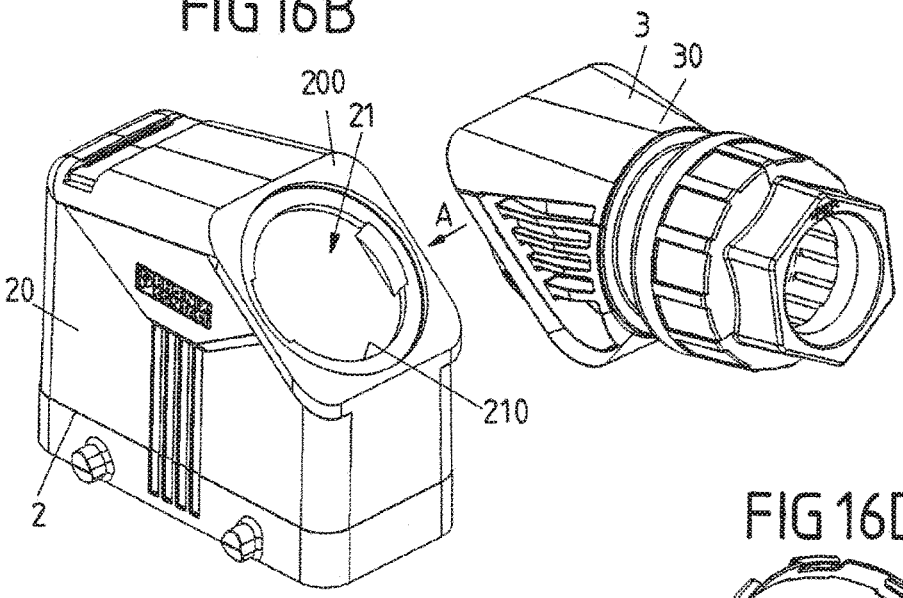
FIG. 16B is a view of the housing of FIG. 16A, before the attachment of the second housing part to the first housing part.
Figure 16D:
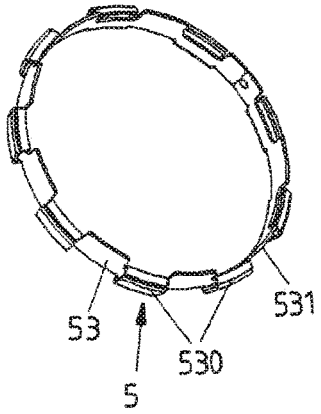
FIG. 16D is a separate view of an elastically resilient closure element which is to be attached to the second housing part.
Figure 16C:
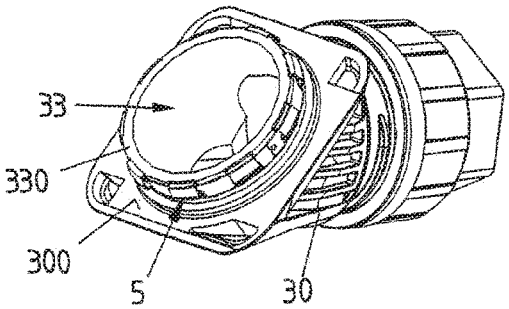
FIG. 16C is a separate view of the second housing part.

In the assembled position, in which the split washer 52 is attached to the collar 330 of the second housing part 3, the radially outer portions 520 of the spring washer 52 project radially outwards from the collar 330, as is illustrated in FIG. 15C. To connect the housing parts 2, 3 together, the second housing part 3 with the collar 330 is inserted into the opening 21 in the attachment face 200 of the first housing part 2 in such a way that the split washer 52 is introduced with its radially outer portions 520 into cutouts 214 on the inner surrounding edge 210 of the opening 21. After passing through the cutouts 214, the second housing part 3 can then be turned in the direction of rotation S relative to the first housing part 2, so that the radially outer portions 520 of the split washer 52 engage in a positive lock behind the surrounding edge 210 and thus produce a positive lock between the housing parts 2, 3.

In the connected position, the split washer 52 is axially compressed along the attachment direction A and thus is braced resiliently between the collar 330 and the surrounding edge 210. In this manner, axial play between the housing parts 2, 3 is compensated for, so that the housing parts 2, 3 along the attachment direction A are held against each other under tension and hence without play.

In an embodiment according to FIG. 16A to 16D, a closure element 5 in the form of a split washer 53 is provided which has elastically resilient spring portions 530 which are bent over to form a ring body 531, which are arranged equally spaced apart in the peripheral direction on the ring body 531 and are configured to be radially resilient. With these spring portions 530, the split washer 53, if attached to a collar 330 on the attachment face 300 of the second housing part 3 (see FIG. 16C), projects radially from the collar 330, so that by attaching the second housing part 3 to the first housing part 2 in the attachment direction A the spring portions 530 can be brought into latching engagement with the inner surrounding edge 210 of the opening 21 in the attachment face 200 of the first housing part 2.

The embodiments of FIGS. 13 to 16 relate to closure elements 5 for producing an axial positive lock between the housing parts 2, 3. As stated, such closure elements can be used in combination with securing against rotation of one of the embodiments according to FIGS. 1 to 12. Such closure elements 5 may in principle however also be used without securing against rotation or using a different type of securing against rotation.

The concept underlying the invention is not restricted to the embodiments described previously, but can in principle also be realized in a completely different manner.

If the locking element is produced as a spring element for example from spring steel and if the housing parts of the housing are manufactured from metal, in particular aluminum, it should be ensured that corrosion does not occur in attaching the locking element to the associated housing part. Such corrosion might occur in particular when the locking element is manufactured from steel and the housing from aluminum. In order to avoid corrosion, the locking element may for example have a suitable coating, a paint or alternatively zinc-plating, which counteract corrosion on a contact face between the locking element and the housing part.

It is however also conceivable and possible to configure the locking element for example from plastics material or aluminum, so that corrosion is avoided from the outset when the housing is made from aluminum.

The same applies to the resilient closure element, which for a configuration from spring steel may be provided with a suitable coating or the like to protect against corrosion or may alternatively be produced from plastics material or aluminum.

The embodiments of different locking elements and different closure elements described previously may in principle also be used in combination, so that for example a closure is provided via a suitable resilient closure element, and securing against rotation is provided via a suitable resilient locking element.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 housing
2 housing part
20 housing body
200 attachment face
201 cutout
202 opening
203 wall
21 opening
210 edge portion
211 closure portion
212 latching lip
213 cutout
214 cutout
22 receiving device
220 fastening element (peg)
221, 222 indentation portion
23 locking receptacle
230 engagement portion
24 collar
240 edge
241 indentation
242 cutout
3 housing part
30 housing body
300 attachment face
31 fastening device (screw nut)
32 opening
33 opening
330 collar
331 closure portion
332 cutout
333 peg
334 cutout
34 engagement portion
340 opening
341 wall portion
35 tool engagement device
4 locking element
40 fastening portion
400 opening
41 spring portion
410 engagement opening
411, 412 portion
42 plate element
420 spring portion (spring tongue)
43 ring element
430 spring portion (spring tongue)
431 plug-in portion
44 pin housing
440 pin
441 spring element
45 spring pin
450 spring element
5 closure element
50 split washer
500 protrusion
501 cutout
51 spring element
510, 511 arm
512 transverse portion
513 protrusion
52 split washer
520, 521 portions
522 cutout
53 ring
530 spring portions
531 ring body
A attachment direction
E direction of insertion
S direction of rotation
V adjustment direction
W, W' spacing

The invention claimed is:

1. A housing for a plug-type connector, comprising:

a first housing part;

a second housing part configured to be connected to the first housing part, the second housing part having a fastening device configured to fasten an electric cable to the housing, wherein the second housing part is configured to be attached to the first housing part in an attachment direction in order to connect to the first housing part, and, in a connected position, is mechanically connected to the first housing part so that the second housing part is held on the first housing part counter to the attachment direction; and a resiliently adjustable locking element arranged on one of the housing parts, the locking element assuming a locking position in the connected position of the housing parts, in which locking position the locking element is engaged with an engagement portion of the other of the housing parts so that the second housing part is locked relative to the first housing part counter to a direction of rotation that is directed about the attachment direction, wherein the locking element projects with a resiliently movable portion along the attachment direction from an attachment face of one of the housing parts, to which face the other of the housing parts is configured to be attached in order to connect the housing parts, and wherein the resiliently movable portion is resiliently movable along the attachment direction.

2. The housing according to claim 1, wherein the locking element is formed to be resilient at least in portions.

3. The housing according to claim 1, wherein the locking element is movable resiliently out of the locking position to detach the housing parts from each other.

4. The housing according to claim 1, wherein the engagement portion is formed by an indentation on the other of the housing parts, into which indentation the locking element engages in the connected position of the housing parts.

5. The housing according to claim 1, wherein the locking element is configured to be received with a fastening portion in a receiving device of one of the housing parts and projects from the attachment face with a spring portion.

6. The housing according to claim 1, wherein the locking element is attached to a wall forming the attachment face, surrounds an opening in the attachment face, and projects from the attachment face with at least one spring tongue.

7. The housing according to claim 6, wherein the locking element lies against a side of the wall that is remote from the attachment face and the at least one spring tongue extends through a cutout in the wall.

8. The housing according to claim 1, wherein the locking element has a pin that is resiliently movable along the attachment direction.

9. The housing according to claim 1, wherein the locking element has a spring pin that is resiliently movable transversely to the attachment direction and along the attachment direction, which pin is configured to be deflected transversely to the attachment direction on connecting the housing parts.

10. The housing according to claim 9, wherein the spring pin upon a turning of the second housing part in the direction of rotation relative to the first housing part for connecting the housing parts together enters into the engagement portion through an opening in the engagement portion, upon a further turning in the direction of rotation enters into engagement with the engagement portion, and in the connected position lies in a locking manner against a wall portion of the engagement portion.

11. The housing according to claim 1, wherein the other of the housing parts has a plurality of engagement portions for connecting the housing parts together in different positions that are turned relative to each other about the attachment direction.

12. The housing according to claim 1, wherein the second housing part, for connecting to the first housing part, is configured to be turned about the attachment direction relative to the first housing part in the direction of rotation.

13. The housing according to claim 1, wherein at least one closure portion is arranged on the first housing part and the second housing part, respectively, which closure portions in the connected position are mechanically engaged with each other and configured to hold the second housing part on the first housing part.

14. A housing for a plug-type connector, comprising:

a first housing part; and a second housing part configured to be connected to the first housing part, the second housing part having a fastening device configured to fasten an electric cable to the housing, wherein the second housing part is configured to be attached to the first housing part in an attachment direction in order to connect to the first housing part, and, in a connected position, is mechanically connected to the first housing part so that the second housing part is held on the first housing part counter to the attachment direction, wherein one of the housing parts has a closure element that is resilient at least in portions, which in the connected position is engaged in a positive lock with at least one closure portion of the other of the housing parts, such that the second housing part is held on the first housing part counter to the attachment direction, wherein the closure element is formed by a ring extended about the attachment direction, which ring at least in portions is formed to be elastically resilient, and wherein the ring has at least one radially projecting portion, the ring being arranged on a collar of the associated housing part so that the ring projects radially from the collar with the at least one radially projecting portion and is configured to be brought into engagement with the at least one closure portion of the other housing part with the at least one radially projecting portion.

15. The housing according to claim 14, wherein the at least one closure portion is formed to be rigid.

16. The housing according to claim 14, wherein the at least one closure portion is formed by an edge portion surrounding an opening, to which at least one closure portion the closure element is configured to be attached in a positive lock.

17. The housing according to claim 14, wherein the ring has different portions that adjoin each other, which are offset relative to each other axially to the attachment direction.

18. The housing according to claim 17, wherein in the connected position the ring is configured to be resiliently braced axially along the attachment direction.

19. The housing according to claim 14, wherein the ring has a ring body that bears at least one spring portion that is bent over relative to the ring body and projects radially from the ring body.

20. The housing according to claim 14, wherein the closure element is arranged on the associated housing part so as to be displaceable transversely to the attachment direction.

21. A housing for a plug-type connector, comprising:

a first housing part;

a second housing part configured to be connected to the first housing part, the second housing part having a fastening device configured to fasten an electric cable to the housing, wherein the second housing part is configured to be attached to the first housing part in an attachment direction in order to connect to the first housing part, and, in a connected position, is mechanically connected to the first housing part so that the second housing part is held on the first housing part counter to the attachment direction; and a resiliently adjustable locking element arranged on one of the housing parts, the locking element assuming a locking position in the connected position of the housing parts, in which locking position the locking element is engaged with an engagement portion of the other of the housing parts so that the second housing part is locked relative to the first housing part counter to a direction of rotation that is directed about the attachment direction, wherein the locking element projects with a resiliently movable portion along the attachment direction from an attachment face of one of the housing parts, to which face the other of the housing parts is configured to be attached in order to connect the housing parts, and wherein the locking element has a pin that is resiliently movable along the attachment direction.

22. A housing for a plug-type connector, comprising:

a first housing part;

a second housing part configured to be connected to the first housing part, the second housing part having a fastening device configured to fasten an electric cable to the housing, wherein the second housing part is configured to be attached to the first housing part in an attachment direction in order to connect to the first housing part, and, in a connected position, is mechanically connected to the first housing part so that the second housing part is held on the first housing part counter to the attachment direction; and a resiliently adjustable locking element arranged on one of the housing parts, the locking element assuming a locking position in the connected position of the housing parts, in which locking position the locking element is engaged with an engagement portion of the other of the housing parts so that the second housing part is locked relative to the first housing part counter to a direction of rotation that is directed about the attachment direction, wherein the locking element projects with a resiliently movable portion along the attachment direction from an attachment face of one of the housing parts, to which face the other of the housing parts is configured to be attached in order to connect the housing parts, and wherein the locking element has a spring pin that is resiliently movable transversely to the attachment direction and along the attachment direction, which pin is configured to be deflected transversely to the attachment direction on connecting the housing parts.

23. The housing according to claim 22, wherein the spring pin upon a turning of the second housing part in the direction of rotation relative to the first housing part for connecting the housing parts together enters into the engagement portion through an opening in the engagement portion, upon a further turning in the direction of rotation enters into engagement with the engagement portion, and in the connected position lies in a locking manner against a wall portion of the engagement portion.

24. A housing for a plug-type connector, comprising:

a first housing part; and a second housing part configured to be connected to the first housing part, the second housing part having a fastening device configured to fasten an electric cable to the housing, wherein the second housing part is configured to be attached to the first housing part in an attachment direction in order to connect to the first housing part, and, in a connected position, is mechanically connected to the first housing part so that the second housing part is held on the first housing part counter to the attachment direction, wherein one of the housing parts has a closure element that is resilient at least in portions, which in the connected position is engaged in a positive lock with at least one closure portion of the other of the housing parts, such that the second housing part is held on the first housing part counter to the attachment direction, wherein the closure element is arranged on the associated housing part so as to be displaceable transversely to the attachment direction.

25. The housing according to claim 24, wherein the closure element is formed by a spring element with two arms extended transversely to the attachment direction, which arms in the connected position are configured to be engaged with the at least one closure portion and are configured to be adjustable transversely to the attachment direction by moving the spring element in order to detach the housing parts from each other.

* * * * *